US005718997A

United States Patent [19]

Hayata et al.

[11] Patent Number: 5,718,997

[45] Date of Patent: Feb. 17, 1998

[54] ELECTROPHOTOGRAPHIC PHOTORECEPTOR

[75] Inventors: Hirofumi Hayata; Akira Kinoshita; Toyoko Shibata; Tomoko Suzuki, all of Hino, Japan

[73] Assignee: Konica Corporation, Tokyo, Japan

[21] Appl. No.: 662,694

[22] Filed: Jun. 13, 1996

[30] Foreign Application Priority Data

| | | | |
|---|---|---|---|
| Jun. 23, 1995 | [JP] | Japan | 7-157831 |
| Jul. 3, 1995 | [JP] | Japan | 7-167385 |
| Feb. 1, 1996 | [JP] | Japan | 8-016712 |

[51] Int. Cl.[6] ..... G03G 5/047; G03G 5/09

[52] U.S. Cl. ..... 430/59; 430/58; 430/83

[58] Field of Search ..... 430/58, 59, 83

[56] References Cited

U.S. PATENT DOCUMENTS

| | | | |
|---|---|---|---|
| 4,869,985 | 9/1989 | Kung et al. | 430/58 |
| 4,909,966 | 3/1990 | Kung et al. | 430/58 |
| 4,913,996 | 4/1990 | Kung et al. | 430/59 |
| 5,023,356 | 6/1991 | Mukai et al. | 430/58 |
| 5,266,429 | 11/1993 | Sorriero et al. | 430/59 |
| 5,324,610 | 6/1994 | Tanaka et al. | 430/83 |

*Primary Examiner*—Roland Martin

*Attorney, Agent, or Firm*—Frishauf, Holtz, Goodman, Langer & Chick, P.C.

[57] ABSTRACT

An electrophotographic photoreceptor comprises a conductive support and provided thereon, a photpreceptive layer containing a compound represented by the following Formula 1:

Formula 1 wherein X represents a group capable of forming a hydrogen bond; and $R_1$, $R_2$ and $R_3$ independently represent a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group or —$NH_2$, —NHR or —NHCOR in which R represents alkyl or aryl; and R' and R" independently represent a hydrogen atom, an alkyl group or an aryl group or R' and R" combine with each other to form a ring.

10 Claims, No Drawings

ELECTROPHOTOGRAPHIC PHOTORECEPTOR

FIELD OF THE INVENTION

The present invention relates to an electrophotographic photoreceptor for forming an electrostatic latent image, and particularly to an electrophotographic photoreceptor comprising a layer containing a compound capable of transporting an electron.

BACKGROUND OF THE INVENTION

An inorganic photoreceptor comprising a layer containing, as main components, inorganic photoconductive compounds such as selenium, zinc oxide, cadmium sulfide and silicon has been widely used, however, these compounds are not satisfactory in view of sensitivity, heat resistance, humidity resistance or durability. Further, some of these compounds are harmful to human body, and have a problem on discarding.

Recently, in order to overcome the above problem, the studies on organic electrophotographic photoreceptors, which comprise a photoreceptive layer containing organic photoconductive compounds, have been eagerly made. Particularly the functionally separated electrophotographic photoreceptors, in which the compound having charge generation capability is different from those compounds having charge transport capability, has an advantage that the respective compounds can be selected from a wide range of compounds. Therefore, since organic photoreceptors having various properties can be easily prepared, many researches have been made and many techniques have been applied for patent.

For example, an electrophotographic photoreceptor comprising a charge generation layer containing a perylene derivative and a charge transport layer containing an oxadiazole derivative is disclosed in U.S. Pat. No. 3,871,882. Further, an electrophotographic photoreceptor employing a distyrylbenzene bisazo compound as a charge generation material and a hydrazone compound as a charge transport material is disclosed in Japanese Patent O.P.I. Publication Nos. 55-84943/1980. Pyrazolines, hydrazones and triphenylamine compounds are known as such typical charge transport material.

However, these are compounds capable of transporting a hole. In a functionally separated type electrophotographic photoreceptor having a charge generation layer containing a charge generation material as a lower layer and a charge transport layer containing a charge transport material as an upper layer, the surface of the photoreceptor requires to be negatively charged. Therefore, a conventional developer used in the inorganic photoreceptors can not be used. Further, ozone produced when the electrophotographic photoreceptor was charged by corona-discharge is more as compared with positively charging inorganic electrophotographic photoreceptors. Much ozone occurrence results in deterioration of the photoreceptors and in adverse affect on human body or working circumstances.

As for positively charging photoreceptors employing an organic photoconductor, a reversely layered electrophotographic photoreceptor having a charge transport layer containing a conventional hole transport material as a lower layer and a charge generation layer containing a charge generation material as an upper layer or a single layered electrophotographic photoreceptor containing a charge transport material and a charge generation material in admixture in the same layer has been researched. However, they are not satisfactory for a high speed copier in view of durability and environmental concerns.

In order to solve the above problems, a charge transport material capable of transporting an electron has been studied. For such charge transport material, 2,4,6-trinitrofluorenone is known, but this compound is poor in solubility in a solvent used or in compatibility with a polymer used as a binder, and has not sufficient properties as a photoconductive layer. Further, this compound has a cancer-producing property.

Recently, several electron transport materials having a solubilizing group in an electron accepting structure are reported, which are described, for example, in Japanese Patent O.P.I. Publication Nos. 1-206349/1889, 2-135362/1990, 2-214866/1990 and 3-290666/1991, and in "Ronbunshu, Japan Hard Copy, '92", p. 173 (1992). However, any of the above compounds could not give enough sensitivity or potential property and are problematic for practical use.

SUMMARY OF THE INVENTION

In view of the above, an object of the invention is to provide an electrophotographic photoreceptor containing an electron transport material capable of transporting an electron which gives high sensitivity, low residual potential, and such excellent durability that the electrophotographic properties do not vary in repeated use.

DETAILED DESCRIPTION OF THE INVENTION

The present inventors have made an extensive study to attain the above object, and have found the object of the invention can be attained by the following photoreceptor:

1. An electrophotographic photoreceptor comprising a conductive support and provided thereon, a photoreceptive layer containing a compound represented by the following Formula 1:

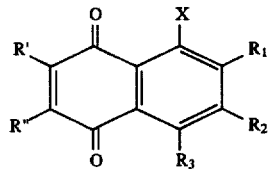

Formula 1 wherein X represents a group capable of forming a hydrogen bond; $R_1$, $R_2$ and $R_3$ independently represent a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group or —$NH_2$, —NHR or —NHCOR in which R represents alkyl or aryl; and R' and R" independently represent a hydrogen atom, an alkyl group or an aryl group or R' and R" combine with each other to form a ring.

2. The electrophotographic photoreceptor of 1 above, wherein said compound is represented by the following Formula 2 or 3:

Formula 2

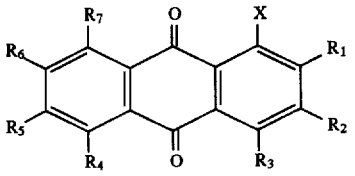

wherein X represents a group capable of forming a hydrogen bond; and $R_1$, $R_2$, $R_3$, $R_4$, $R_5$, $R_6$ and $R_7$ independently represent a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group or —$NH_2$, —NHR or —NHCOR in which R represents an alkyl group or an aryl group.

Formula 3

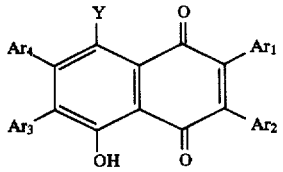

wherein Y represents a hydrogen atom or a hydroxy group; and $Ar_1$, $Ar_2$, $Ar_3$ and $Ar_4$ independently represent a hydrogen atom or an aryl group.

3. The electrophotographic photoreceptor of 2 above, wherein said compound is represented by said Formula 2.

4. The electrophotographic photoreceptor of 3 above, wherein said compound represented by said Formula 2 is represented by Formula 4:

Formula 4

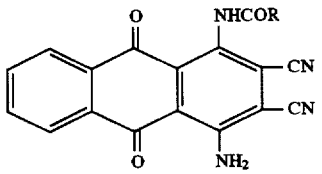

wherein R represents an alkyl group or an aryl group.

5. An electrophotographic photoreceptor comprising a conductive support and provided thereon, a photoreceptive layer containing a compound represented by the following Formula 5, 6, 7 or 8:

Formula 5

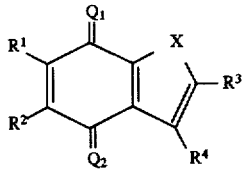

wherein X represents O, S or Se; $Q_1$ and $Q_2$ independently represent =O, $=C(CN)_2$, $=C(CO_2R^5)_2$, $=C(CN)(CO_2R^5)$, =N—CN or $=N—CO_2R^5$; $R^1$ through $R^4$ independently represent a hydrogen atom, a halogen atom, a cyano group, a nitro group, an acyl group or a substituted or unsubstituted alkyl, alkoxy, aryl, sulfonyl or ester group; and $R^5$ represents a substituted or unsubstituted alkyl, aryl or heterocyclic group, Formula 6

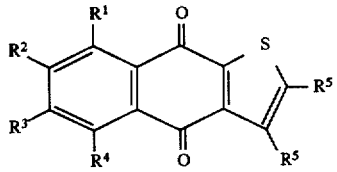

wherein $R^1$, $R^2$, $R^3$ and $R^4$ independently represent a hydrogen atom or a substituted or unsubstituted aryl or heterocyclic group; and $R^5$ and $R^6$ independently represent a hydrogen atom or a substituted or unsubstituted alkyl or aryl group, Formula 7

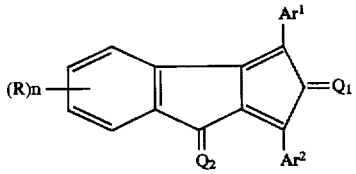

wherein $Q_1$ and $Q_2$ independently represent =O, $=C(CN)_2$, $=C(CO)_2R')_2$, $=C(CN)(CO_2R')$, =N—Ar' or =NCN in which R' represents a substituted or unsubstituted alkyl group and Ar' represents a substituted or unsubstituted aryl group; $Ar^1$ and $Ar^2$ independently represent a substituted or unsubstituted aryl group; R represents a hydrogen atom, a halogen atom, a cyano group, a nitro group, an alkyl group or an aryl group; and n represents an integer of 1 to 4, Formula 8

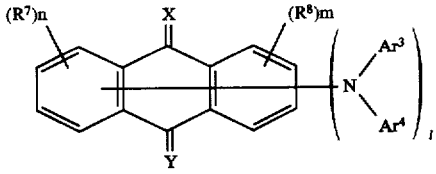

wherein X and Y independently represent oxygen or =N—CN; $R^7$ and $R^8$ independently represent a halogen atom, an alkyl group, a cyano group, a nitro group, a carboxylate ester group, a carboxyl group, a substituted or unsubstituted acyl, aryl, aralkyl, alkoxy or heterocyclic group; n and m independently represent an integer of 0 to 4, provided that when n and m are two or more, $R^7$ and $R^8$ may be the same or different; $Ar^3$ and $Ar^4$ independently represent a substituted or unsubstituted aryl, or heterocyclic group; and 1 represents an integer of 1 to 4.

Next, the examples of the electron transport material will be shown, but the invention is not limited thereto.

(A) Compounds represented by Formula 1.

In Formula 1, X represents a group capable of forming a hydrogen bond; $R_1$, $R_2$ and $R_3$ independently represent a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group or —$NH_2$, —NHR or —NHCOR in which R represents alkyl or aryl; and R' and R" independently represent a hydrogen atom, an alkyl group or an aryl group or R' and R" combine with each other to form a ring. The examples of X are preferably a hydroxy group, an amino group, an alkylamino group, an arylamino group, an acylamino group, an amido group, a carboxyl group, a carboxyamino group, an alkoxycarbonylamino group, an aryloxycarbonylamino group, a sulfonamide group, a sulfonylamino group or a sulfinylamino group, and more preferably a hydroxy group, an amino group, an alkylamino group, an arylamino group, an acylamino group or an amido group. The alkyl represented by $R_1$, $R_2$, $R_3$, R, R' or R" includes a methyl group, an ethyl group or a straight-chained or branched alkyl group having 3 to 9 carbon atoms, the aryl group represented by $R_1$, $R_2$, $R_3$, R, R' or R" includes a phenyl group or a naphthyl group, the aralkyl group represented by $R_1$, $R_2$ or $R_3$ includes a benzyl group or a phenetyl group, the alkoxy group represented by $R_1$, $R_2$ or $R_3$ includes a methoxy, ethoxy, propoxy or butoxy group, the aryloxy group represented by $R_1$, $R_2$ or $R_3$ includes a phenoxy or naphthoxy group, and the heterocyclic group represented by $R_1$, $R_2$ or $R_3$ includes a furyl, thiofuryl, pyrrolyl, pyridyl or pyranyl group.

The alkyl, aryl, aralkyl, alkoxy, aryloxy or heterocyclic group described above may have a substituent, and the substituent includes an alkyl, aryl, aralkyl, alkoxy, aryloxy or heterocyclic group, a halogen atom, a hydroxy group, a nitro group, a cyano group, an acyl group, a urethane group, a carboxyl group, a carboxylate ester group, an amino group or an amido group. The alkyl group of the substituent includes a methyl group, an ethyl group or a straight-chained or branched alkyl group having 3 to 9 carbon atoms, the aryl group of the substituent includes a phenyl group or a naphthyl group, the aralkyl group of the substituent includes a benzyl group or a phenetyl group, the alkoxy group of the substituent includes a methoxy, ethoxy, propoxy or butoxy group, the aryloxy group of the substituent includes a phenoxy or naphthoxy group, and the heterocyclic group of the substituent includes a furyl, thiofuryl, pyrrolyl, pyridyl or pyranyl group.

(B) Compounds represented by Formula 2

In Formula 1, X represents a group capable of forming a hydrogen bond; and $R_1$, $R_2$, $R_3$, $R_4$, $R_5$, $R_6$ and $R_7$ independently represent a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group or —$NH_2$, —NHR or —NHCOR in which R represents an alkyl group or an aryl group. The examples of X are preferably a hydroxy group, an amino group, an alkylamino group, an arylamino group, an acylamino group, an amido group, a carboxyl group, a carboxyamino group, an alkoxycarbonylamino group, an aryloxycarbonylamino group, a sulfonamide group, a sulfonylamino group or a sulfinylamino group, and more preferably a hydroxy group, an amino group, an alkylamino group, an arylamino group, an acylamino group or an amido group. The group represented by $R_1$, $R_2$, $R_3$, $R_4$, $R_5$, $R_6$, $R_7$ and R may have a substituent, and the substituent includes those as denoted in (A) above.

The exemplified compounds and synthetic example of compounds represented by Formula 2 will be shown below.

Exemplified compounds

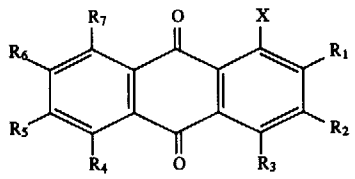
Formula 2
| Exemplified compounds No. | $R_1$ | $R_2$ | $R_3$ | $R_4$ | $R_5$ | $R_6$ | $R_7$ | X |
|---|---|---|---|---|---|---|---|---|
| 2-1 | H | $C_2H_5$ | H | H | H | H | H | OH |
| 2-2 | H | H | H | H | $-CH_2-$ 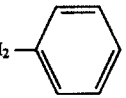 | $-OCH_3$ | H | OH |
| 2-3 | H | H | OH | H | 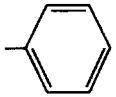 | 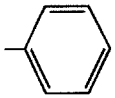 | H | OH |
| 2-4 | $-COOC_8H_{17}$ | H | H | H | H | H | H | OH |
| 2-5 | H | $-COOH$ | H | $NO_2$ | H | $-O-$ 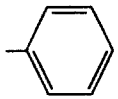 | H | OH |
| 2-6 | CN | CN | OH | H | H | H | H | OH |
| 2-7 | H | H | H | $NO_2$ | $-COOC_5H_9$ | H | H | $NH_2$ |
| 2-8 | CN | CN | $NH_2$ | H | H | H | H | $NH_2$ |
| 2-9 | H | $NO_2$ | H | H | 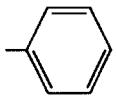 | 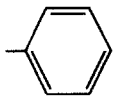 | 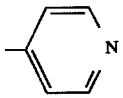 N | $NH_2$ |
| 2-10 | H | H | $NO_2$ | H | 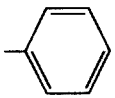 | 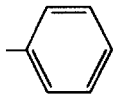 | H | $-NHCH_3$ |
| 2-11 | OH | H | H | $NO_2$ | H | H | H | OH |

-continued

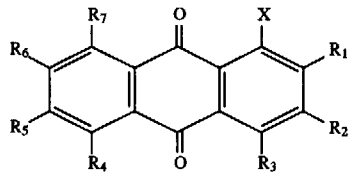

Formula 2

| Exemplified compounds No. | $R_1$ | $R_2$ | $R_3$ | $R_4$ | $R_5$ | $R_6$ | $R_7$ | X |
|---|---|---|---|---|---|---|---|---|
| 2-12 | CN | CN | $-NHCOtC_4H_9$ | H | H | H | H | $-NHCO-C(CH_3)_3$ |
| 2-13 | Cl | Cl | $-NHCOC_9H_{19}$ | H | H | H | H | $-NHCOC_9H_{19}$ |
| 2-14 | H | H | H | H | H | H | H | $-NHCOC_9H_{19}$ |
| 2-15 | H | $NO_2$ | $CH_3$ | H | H | H | H | OH |
| 2-16 | CN | CN | $-NHCOC_9H_{19}$ | H | H | H | H | $-NHCOC_9H_{19}$ |
| 2-17 | $NO_2$ | H | $NO_2$ | H | H | H | H | OH |
| 2-18 | CN | CN | $-NHCOC_9H_{19}$ | H | H | H | H | $-NHCOC_2H_4-C_6H_5$ |
| 2-19 | H | OH | $NO_2$ | OH | H | OH | $NO_2$ | OH |
| 2-20 | CN | CN | $-NHCOCH_3$ | H | H | H | H | $-NHCOCH_3$ |
| 2-21 | H | H | H | H | $NO_2$ | H | H | $-NH-C_6H_5$ |
| 2-22 | Br | H | Br | H | H | H | H | $-NHCOC_8H_{17}$ |
| 2-23 | H | H | $NO_2$ | H | H | H | H | $-NHCOC_9H_{19}$ |
| 2-24 | $NO_2$ | H | $-NHCOC_9H_{17}$ | H | H | H | H | $-NHCOC_9H_{17}$ |
| 2-25 | H | H | H | H | H | H | H | $-NHCOC_2H_5$ |
| 2-26 | $NO_2$ | H | H | H | H | H | H | $-NHCOOC_9H_{19}$ |

-continued
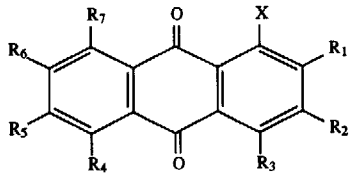
Formula 2
| Exemplified compounds No. | $R_1$ | $R_2$ | $R_3$ | $R_4$ | $R_5$ | $R_6$ | $R_7$ | X |
|---|---|---|---|---|---|---|---|---|
| 2-27 | CN | CN | $-NHCOOC_9H_{17}$ | H | H | H | H | $-NHCOOC_9H_{19}$ |
| 2-28 | 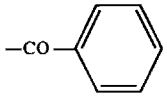 | H | H | H | H | H | H | $-NHCOCH_3$ |
| 2-29 | CN | CN | $-NHCOtC_4H_9$ | 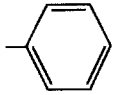 | 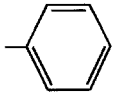 | 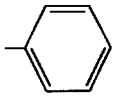 | 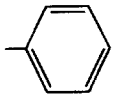 | $-NHCOtC_4H_9$ |
| 2-30 | CN | CN | $-NHCOC_8H_{17}$ | H | 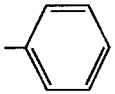 | 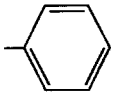 | 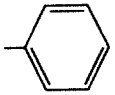 | $-NHCOC_8H_{17}$ |
| 2-31 | CN | CN | 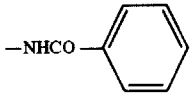 | H | H | H | H | 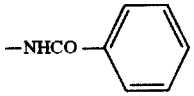 |
| 2-32 | CN | CN | $-NHCOC_8H_{17}$ | H | H | H | H | $-NHCOC_8H_{17}$ |
| 2-33 | CN | CN | $-NHCOC_7H_{15}$ | H | H | H | H | $-NHCOC_7H_{15}$ |
| 2-34 | CN | CN | $-NHCOC_6H_{13}$ | H | H | H | H | $-NHCOOC_6H_{13}$ |
| 2-35 | H | H | H | H | H | H | H | $-COOH$ |
| 2-36 | H | H | H | H | H | H | H | $-OCOOH$ |
| 2-37 | H | H | H | H | H | H | H | $-NHCOOH$ |
| 2-38 | H | H | H | H | H | H | H | $-NHCOOCH_3$ |
| 2-39 | H | H | H | H | H | H | H | $-CONH_2$ |

-continued
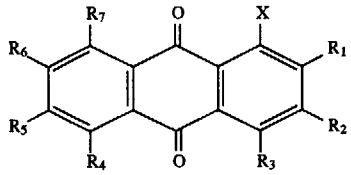
Formula 2
| Exemplified compounds No. | $R_1$ | $R_2$ | $R_3$ | $R_4$ | $R_5$ | $R_6$ | $R_7$ | X |
|---|---|---|---|---|---|---|---|---|
| 2-40 | H | H | H | H | H | H | H | $-S(=O)_2-NHC_4H_9$ |
| 2-41 | H | H | H | H | H | H | H | $-NH-S(=O)_2-C_4H_9$ |
| 2-42 | H | H | H | H | H | H | H | $-NH-S(=O)-C_4H_9$ |
| 2-43 | CN | CN | SH | H | H | H | H | SH |

Synthetic Example (Synthesis of Exemplified Compound 2-16)

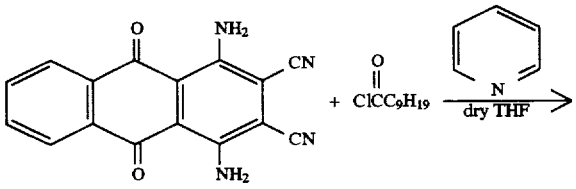

2

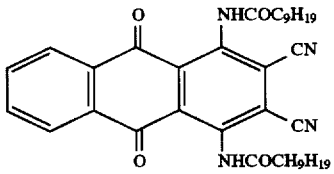

2-16

In a dry 200 ml three necked flask were mixed 8.2 g of Compound 2 (crude), 50 ml of dry THF, 3.0 g of pyridine and 6.0 g of decanoylchloride (produced by Kanto Kagaku Co., Ltd.). The mixture was stirred for one hour while cooled with ice, and stirred for additional 3 hours at room temperature, and then mixed with 30 ml of ethanol and stirred for 30 minutes. The resulting mixture was poured into 300 ml of water, and extracted with toluene. The toluene solution was dried and concentrated. The concentrated solution was subjected to column chromatography and the objective crude compound was isolated. The compound was recrystallized from a mixture solution of toluene and hexane. Thus, 2.8 g of Exemplified compound 2-16 were obtained.

(C) Compounds represented by Formula 3

In Formula 3, the aryl group represented by $Ar_1$ through $Ar_4$ may have a substituent, and the substituent is preferably alkyl, alkoxy, aryl, aryloxy, acyl, acyloxy, carbamoyl, halogen, nitro or cyano.

The typical examples of compounds represented by Formula 3 will be shown below.

| No. | R | $Ar_1$ | $Ar_2$ | $Ar_3$ | $Ar_4$ |
|---|---|---|---|---|---|
| 3-1 | H | 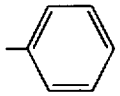 | H | H | H |
| 3-2 | H | H | 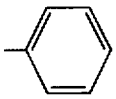 | H | H |
| 3-3 | H | 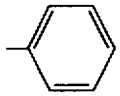 | 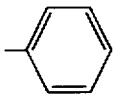 | H | H |
| 3-4 | H | 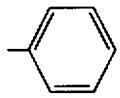 | H | 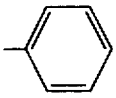 | H |
| 3-5 | H | 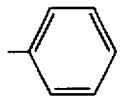 | H | H | 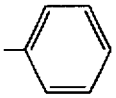 |
| 3-6 | H | H | 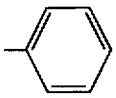 | 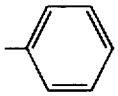 | H |
| 3-7 | H | H | 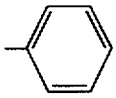 | H | 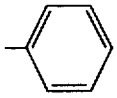 |
| 3-8 | H | 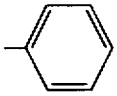 | 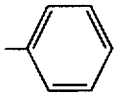 | 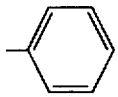 | H |
| 3-9 | H | 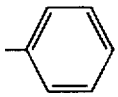 | 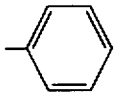 | H | 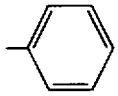 |

-continued
| No. | R | $Ar_1$ | $Ar_2$ | $Ar_3$ | $Ar_4$ |
|---|---|---|---|---|---|
| 3-10 | H | 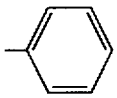 | 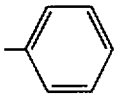 | 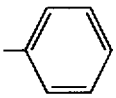 | 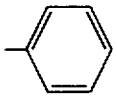 |
| 3-11 | H | 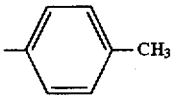 | H | H | H |
| 3-12 | H | H | 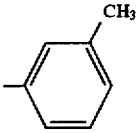 | H | H |
| 3-13 | H | 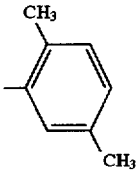 | H | H | H |
| 3-14 | H | 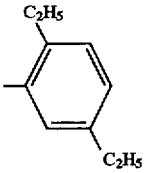 | H | H | H |
| 3-15 | H | 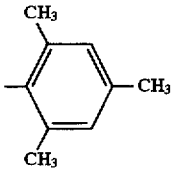 | H | H | H |
| 3-16 | H | H | 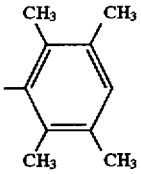 | H | H |
| 3-17 | H | H | 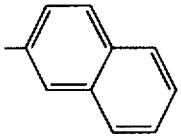 | H | H |
| 3-18 | H | H | 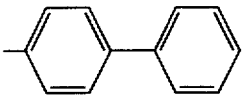 | H | H |
| 3-19 | H | 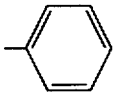 | H | 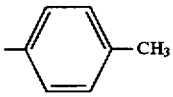 | H |
| 3-20 | H | 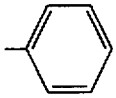 | H | H | 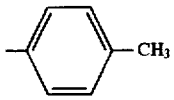 |

-continued
| No. | R | $Ar_1$ | $Ar_2$ | $Ar_3$ | $Ar_4$ |
|---|---|---|---|---|---|
| 3-21 | H | 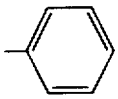 | H | 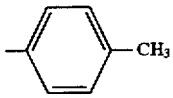 | 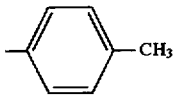 |
| 3-22 | H | 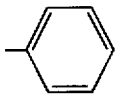 | H | 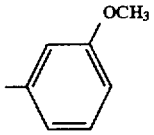 | H |
| 3-23 | H | 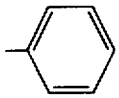 | H | 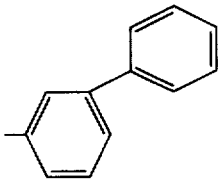 | H |
| 3-24 | H | 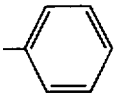 | H | 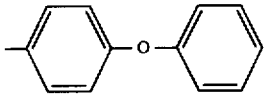 | H |
| 3-25 | H | 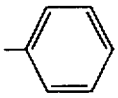 | H | 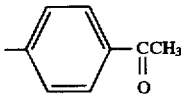 | H |
| 3-26 | H | 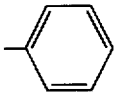 | H | 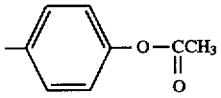 | H |
| 3-27 | H | 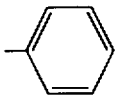 | H | 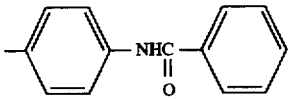 | H |
| 3-28 | H | 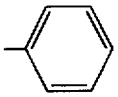 | H | 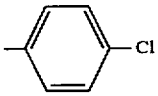 | H |
| 3-29 | H | 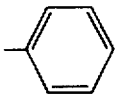 | H | 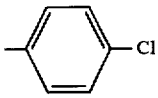 | 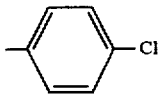 |
| 3-30 | H | 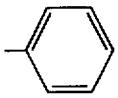 | H | 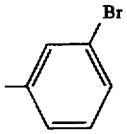 | H |
| 3-31 | H | 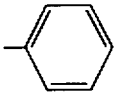 | H | 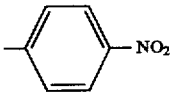 | H |
| 3-32 | H | 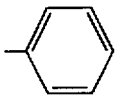 | H | H | 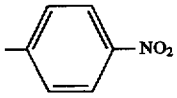 |
| 3-33 | H | 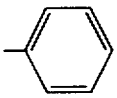 | H | 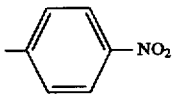 | 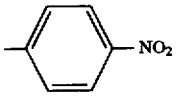 |

-continued
| No. | R | $Ar_1$ | $Ar_2$ | $Ar_3$ | $Ar_4$ |
|---|---|---|---|---|---|
| 3-34 | H | 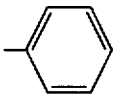 | H | 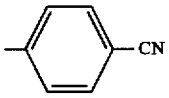 | H |
| 3-35 | H | H | 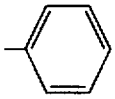 | 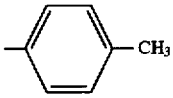 | H |
| 3-36 | H | H | 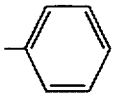 | H | 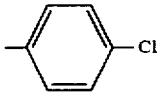 |
| 3-37 | H | H | 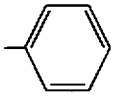 | 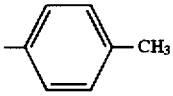 | 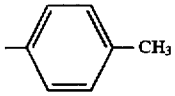 |
| 3-38 | H | 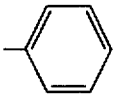 | 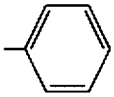 | 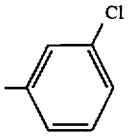 | H |
| 3-39 | H | 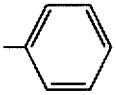 | 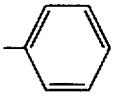 | H | 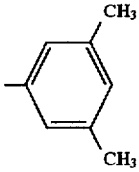 |
| 3-40 | H | 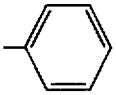 | 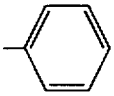 | 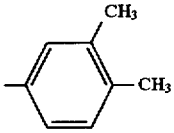 | 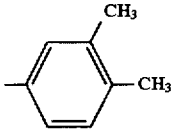 |
| 3-41 | OH | 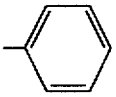 | H | H | H |
| 3-42 | OH | 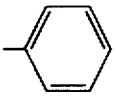 | 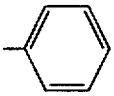 | H | H |
| 3-43 | OH | 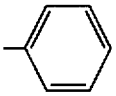 | H | 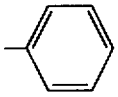 | H |
| 3-44 | OH | 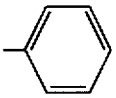 | H | H | 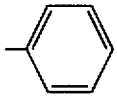 |
| 3-45 | OH | 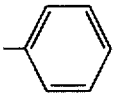 | 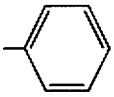 | 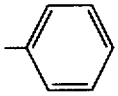 | H |
| 3-46 | OH | 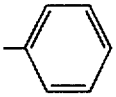 | 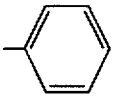 | 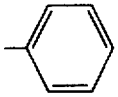 | 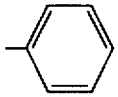 |

-continued
| No. | R | $Ar_1$ | $Ar_2$ | $Ar_3$ | $Ar_4$ |
|---|---|---|---|---|---|
| 3-47 | OH | 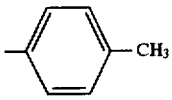 | H | H | H |
| 3-48 | OH | 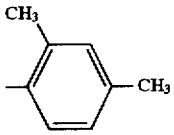 | H | H | H |
| 3-49 | OH | 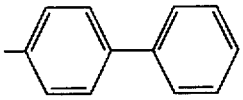 | H | H | H |
| 3-50 | OH | 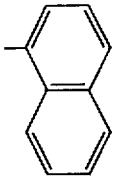 | H | H | H |
| 3-51 | OH | 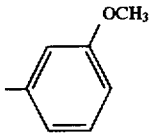 | H | H | H |
| 3-52 | OH | 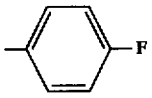 | H | H | H |
| 3-53 | OH | 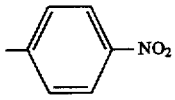 | H | H | H |
| 3-54 | OH | 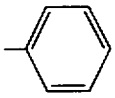 | 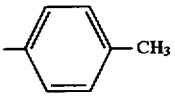 | H | H |
| 3-55 | OH | 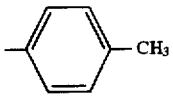 | 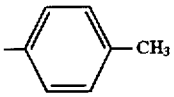 | H | H |
| 3-56 | OH | 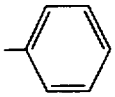 | H | 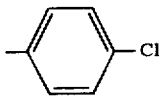 | H |
| 3-57 | OH | 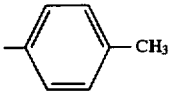 | H | 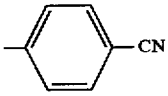 | H |
| 3-58 | OH | 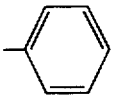 | H | H | 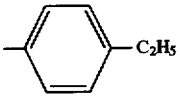 |
| 3-59 | OH | 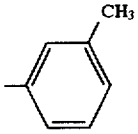 | H | H | 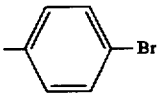 |

-continued

| No. | R | $Ar_1$ | $Ar_2$ | $Ar_3$ | $Ar_4$ |
|---|---|---|---|---|---|
| 3-60 | OH | 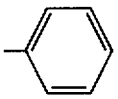 | 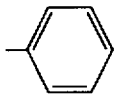 | 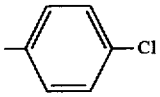 | H |
| 3-61 | OH | 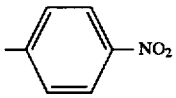 | 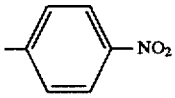 | 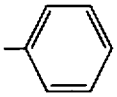 | H |
| 3-62 | OH | 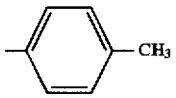 | 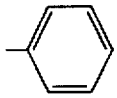 | 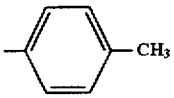 | H |
| 3-63 | OH | 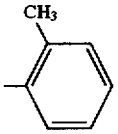 | 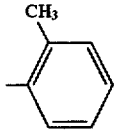 | 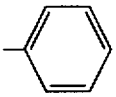 | 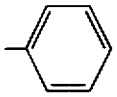 |
| 3-64 | OH | 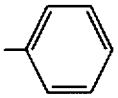 | 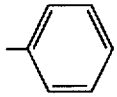 | 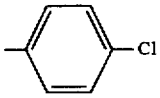 | 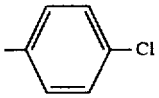 |
| 3-65 | OH | 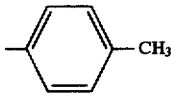 | 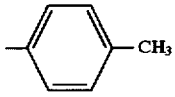 | 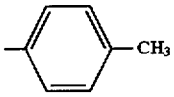 | 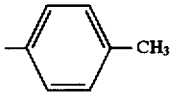 |

The above compound can be synthesized according to a conventional method, for example, a method described in J. Org. Chem., 50, 5546 (1985) or Ann., 462, 72 (1928).

Synthetic example of the typical compound will be shown below.

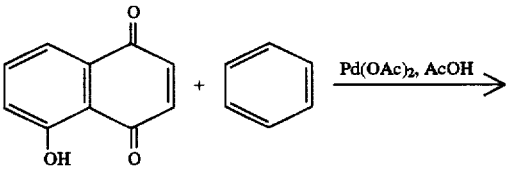

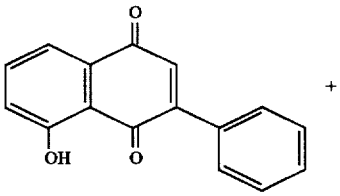

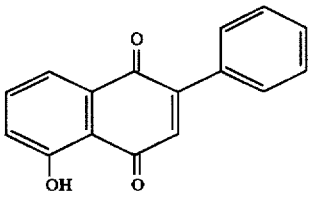

-continued

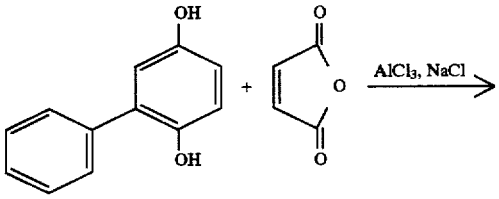

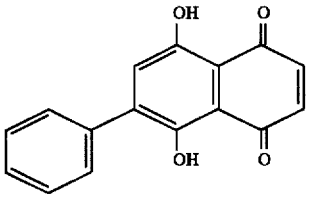

The other compounds can be similarly synthesized by changing substituents.

(D) Compounds represented by Formula 4

Exemplified compounds of compounds represented by Formula and their synthetic example will be shown below.

Exemplified compounds

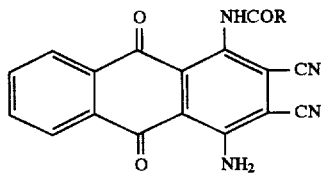

Formula 4

| No. | R |
|---|---|
| 4-1 | $-CH_3$ |
| 4-2 | $-CH_2CH_3$ |
| 4-3 | $-CH_2CH_2CH_3$ |
| 4-4 | $-CH_2(CH_2)_2CH_3$ |
| 4-5 | $-CH_2(CH_2)_3CH_3$ |
| 4-6 | $-CH_2(CH_2)_4CH_3$ |
| 4-7 | $-CH_2(CH_2)_5CH_3$ |
| 4-8 | $-CH_2(CH_2)_6CH_3$ |
| 4-9 | $-CH_2(CH_2)_7CH_3$ |
| 4-10 | $-CH_2(CH_2)_8CH_3$ |
| 4-11 | $-CH_2(CH_2)_9CH_3$ |
| 4-12 | $-CH_2(CH_2)_{11}CH_3$ |
| 4-13 | $-CH(CH_3)_2$ |
| 4-14 | $-C(CH_3)_3$ |
| 4-15 | $-CH_2CH(CH_3)_2$ |
| 4-16 | $-CHC(CH_3)_3$ |
| 4-17 | $-CH(CH_2)_2CH_3$ <br> \| <br> $CH_2CH_3$ |

Synthetic Example (Synthesis of Exemplified Compound 4-8)

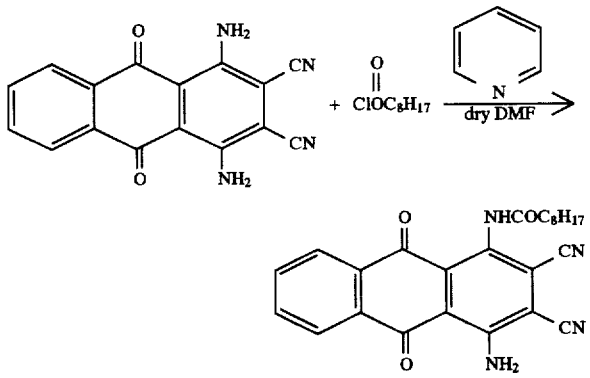

4-8

In a dry 100 ml three necked flask were mixed 3.0 g of 1,4-diamino-2,3-dicyanoanthraquinone (produced by Sanwa Kagaku Co., Ltd.), 50 ml of dry DMF and 5 ml of pyridine and 3.0 g of pelargonic acid chloride (produced by Tokyo Kaseikogyo Co., Ltd.) were added dropwise at 0°–5° C. The mixture was stirred for two hours at around 20° C. and then mixed with 50 ml of ethanol and stirred for 30 minutes. The resulting mixture was poured into 300 ml of water, and extracted with toluene. The toluene solution was dried and concentrated. The concentrated solution was subjected to column chromatography and the objective crude compound was isolated. The compound was recrystallized from a mixture solution of toluene and methanol. Thus, 0.72 g of Exemplified compound 4-8 were obtained.

(E) Compounds represented by Formula 5

It is preferable that in Formula 5, R represents a substituted or unsubstituted alkyl, aryl or heterocyclic group, and $R^1$, $R^2$, $R^3$ and $R^4$ independently represent a hydrogen atom or a substituted or unsubstituted aryl group.

In Formula 5, the specially preferable examples are as follows:

Exemplified compounds

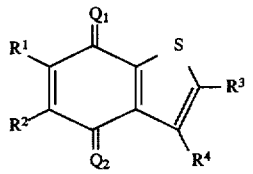

5-A

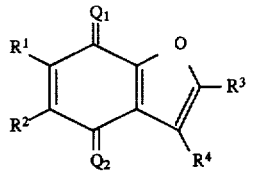

5-B

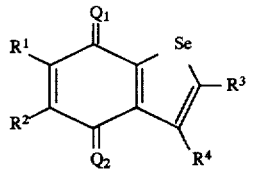

5-C

| No. | $Q_1$ | $Q_2$ | $R^1$ | $R^2$ | $R^3$ | $R^4$ |
|---|---|---|---|---|---|---|
| 5-1 | O | O | H | H | H | H |
| 5-2 | O | 0 | H | $CH_3$ | H | H |
| 5-3 | O | O | H | $C_4H_9$ | H | H |
| 5-4 | O | O | H | $OCH_3$ | H | H |
| 5-5 | O | 0 | H | $CO_2C_2H_5$ | H | H |
| 5-6 | O | O | H | Cl | H | H |
| 5-7 | O | O | H | $CF_3$ | H | H |
| 5-8 | O | O | H | $CH_2F$ | H | H |
| 5-9 | O | O | H | Ph | H | H |
| 5-10 | O | O | H | p-$CH_3$−Ph | H | H |
| 5-11 | O | O | H | CN | H | H |
| 5-12 | O | O | H | $NO_2$ | H | H |
| 5-13 | O | O | Ph | H | H | H |
| 5-14 | O | O | Ph | $CH_3$ | Ph | H |
| 5-15 | O | O | Ph | $C_4H_9$ | Ph | H |
| 5-16 | O | O | Ph | $OCH_3$ | Ph | H |
| 5-17 | O | O | Ph | $CO_2C_2H_5$ | $CO_2C_2H_5$ | H |
| 5-18 | O | O | Ph | Cl | $CO_2C_2H_5$ | H |
| 5-19 | O | O | Ph | $CF_3$ | $CO_2C_2H_5$ | H |
| 5-20 | O | O | Ph | $CH_2F$ | $CO_2C_2H_5$ | H |
| 5-21 | O | O | Ph | Ph | H | H |
| 5-22 | O | O | Ph | p-$CH_3$−Ph | H | H |
| 5-23 | O | O | Ph | CN | H | H |
| 5-24 | O | O | Ph | $NO_2$ | H | H |
| 5-25 | O | O | $CH_3$ | H | Ph | H |
| 5-26 | O | O | $CH_3$ | $CH_3$ | Ph | H |
| 5-27 | O | O | $CH_3$ | P−CN−Ph | Ph | H |
| 5-28 | O | O | $CH_3$ | $OCH_3$ | Ph | H |
| 5-29 | O | O | $CH_3$ | $CO_2C_2H_5$ | Ph | H |
| 5-30 | O | O | $CH_3$ | Ph | Ph | H |
| 5-31 | $C(CN)_2$ | O | H | H | H | H |
| 5-32 | $C(CN)_2$ | O | H | $CH_3$ | H | H |
| 5-33 | $C(CN)_2$ | O | H | $C_4H_9$ | H | H |
| 5-34 | $C(CN)_2$ | O | H | $OCH_3$ | H | $C_2H_5$ |
| 5-35 | $C(CN)_2$ | O | H | $CO_2C_2H_5$ | H | $C_2H_5$ |
| 5-36 | $C(CN)_2$ | O | H | Cl | $CH_3$ | $C_2H_5$ |
| 5-37 | $C(CN)_2$ | O | H | $CF_3$ | $CH_3$ | $C_2H_5$ |
| 5-38 | $C(CN)_2$ | O | H | $CH_2F$ | $CH_3$ | $C_2H_5$ |
| 5-39 | $C(CN)_2$ | O | H | Ph | $CH_3$ | Ph |
| 5-40 | $C(CN)_2$ | O | H | p-$CH_3$−Ph | Ph | Ph |
| 5-41 | $C(CN)_2$ | O | H | CN | Ph | Ph |
| 5-42 | $C(CN)_2$ | O | H | $NO_2$ | Ph | Ph |
| 5-43 | $C(CN)_2$ | $C(CN)_2$ | H | H | Ph | Ph |
| 5-44 | $C(CN)_2$ | $C(CN)_2$ | H | H | p-$CH_3$−Ph | Ph |
| 5-45 | $C(CN)_2$ | $C(CN)_2$ | H | H | p-$CH_3$−Ph | $OCH_3$ |
| 5-46 | $C(CN)_2$ | $C(CN)_2$ | H | $COCH_3$ | p-$CH_3$−Ph | $CO_2C_4H_9$ |
| 5-47 | $C(CN)_2$ | $C(CO_2CH_3)_2$ | H | $COCH_3$ | p-$CH_3$−Ph | H |
| 5-48 | $C(CN)_2$ | $C(CO_2CH_3)_2$ | H | $SO_2$−Ph | p-$CH_3$−Ph | Ph |
| 5-49 | $C(CN)_2$ | $C(CO_2CH_3)_2$ | H | $SO_2$−Ph | p-$CH_3$−Ph | $CH_3$ |
| 5-50 | $C(CN)_2$ | $C(CO_2CH_3)_2$ | H | $SO_2$−Ph | p-$CH_3$−Ph | $CO_2C_4H_9$ |

-continued

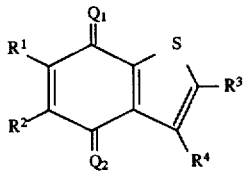

5-A

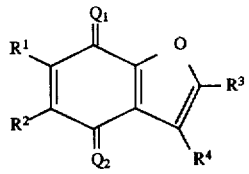

5-B

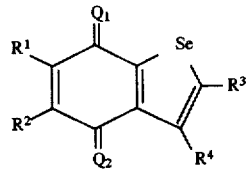

5-C

| No. | $Q_1$ | $Q_2$ | $R^1$ | $R^2$ | $R^3$ | $R^4$ |
|---|---|---|---|---|---|---|
| 5-51 | $C(CN)_2$ | $C(CO_2CH_3)_2$ | H | $SO_2-Ph$ | Ph | Ph |
| 5-52 | $C(CN)_2$ | $C(CO_2CH_3)_2$ | H | $SO_2-Ph$ | Ph | H |
| 5-53 | $C(CN)_2$ | $C(COCH_3)_2$ | H | $SO-Ph$ | Ph | $C_2H_5$ |
| 5-54 | $C(CN)_2$ | $C(CO_2CH_3)_2$ | H | $COCH(CH_3)_2$ | Ph | $OCH_3$ |
| 5-55 | $C(CO_2CH_3)_2$ | $C(CO_2CH_3)_2$ | H | $COCH(CH_3)_2$ | Ph | Ph |
| 5-56 | $C(CO_2CH_3)_2$ | $C(CO_2CH_3)_2$ | H | $COCH(CH_3)_2$ | Ph | H |
| 5-57 | $C(CO_2CH_3)_2$ | $C(CO_2CH_3)_2$ | H | $COCH(CH_3)_2$ | Ph | $C_2H_5$ |
| 5-58 | $C(CO_2CH_3)_2$ | $C(CO_2CH_3)_2$ | H | $COCH(CH_3)_2$ | Ph | $OCH_3$ |
| 5-59 | $C(CO_2CH_3)_2$ | $C(CO_2CH_3)_2$ | H | $COCH(CH_3)_2$ | $p-CH_3-Ph$ | H |
| 5-60 | $C(CO_2CH_3)_2$ | $C(CO_2CH_3)_2$ | H | $COCH(CH_3)_2$ | $p-CH_3-Ph$ | Ph |
| 5-61 | $N-CN$ | O | H | H | H | H |
| 5-62 | $N-CN$ | O | H | $CH_3$ | H | H |
| 5-63 | $N-CN$ | O | H | $C_4H_9$ | H | H |
| 5-64 | $N-CN$ | O | H | $OCH_3$ | H | $C_2H_5$ |
| 5-65 | $N-CN$ | O | H | $CO_2C_2H_5$ | H | $C_2H_5$ |
| 5-66 | $N-CN$ | O | H | Cl | $CH_3$ | $C_2H_5$ |
| 5-67 | $N-CN$ | O | H | $CF_3$ | $CH_3$ | $C_2H_5$ |
| 5-68 | $N-CN$ | O | H | $CH_2F$ | $CH_3$ | $C_2H_5$ |
| 5-69 | $N-CN$ | O | H | Ph | $CH_3$ | Ph |
| 5-70 | $N-CN$ | O | H | $p-CH_3-Ph$ | Ph | Ph |
| 5-71 | $N-CN$ | O | H | CN | Ph | Ph |
| 5-72 | $N-CN$ | O | H | $NO_2$ | Ph | Ph |
| 5-73 | $N-CN$ | $N-CN$ | H | H | Ph | Ph |
| 5-74 | $N-CN$ | $N-CN$ | H | H | $p-CH_3-Ph$ | Ph |
| 5-75 | $N-CN$ | $N-CN$ | H | H | $p-CH_3-Ph$ | $OCH_3$ |
| 5-76 | $N-CN$ | $N-CN$ | H | H | $p-CH_3-Ph$ | $CO_2C_4H_9$ |
| 5-77 | $N-CN$ | $N-CO_2C_4H_9$ | H | H | $p-CH_3-Ph$ | H |
| 5-78 | $N-CN$ | $N-CO_2C_4H_9$ | H | H | $p-CH_3-Ph$ | Ph |
| 5-79 | $N-CN$ | $N-CO_2C_4H_9$ | H | H | $p-CH_3-Ph$ | $CH_3$ |
| 5-80 | $N-CN$ | $N-CO_2C_4H_9$ | H | H | $p-CH_3-Ph$ | $CO_2C_4H_9$ |
| 5-81 | $N-CN$ | $N-CO_2C_4H_9$ | H | H | Ph | Ph |
| 5-82 | $N-CN$ | $N-CO_2C_4H_9$ | H | H | Ph | H |
| 5-83 | $N-CN$ | $C(CN)CO_2CH_3$ | H | H | Ph | $C_2H_5$ |
| 5-84 | $N-CN$ | $C(CN)CO_2CH_3$ | H | H | Ph | $OCH_3$ |
| 5-85 | $N-CO_2C_4H_9$ | $C(CN)CO_2CH_3$ | H | H | Ph | Ph |
| 5-86 | $N-CO_2C_4H_9$ | $C(CN)CO_2CH_3$ | H | H | Ph | H |
| 5-87 | $N-CO_2C_4H_9$ | $N-CO_2-Ph$ | H | H | Ph | $C_2H_5$ |
| 5-88 | $N-CO_2C_4H_9$ | $N-CO_2-Ph$ | H | H | Ph | $OCH_3$ |
| 5-89 | $C(CN)CO_2-TPh$ | $N-CO_2-Ph$ | H | H | $p-CH_3-Ph$ | H |
| 5-90 | $C(CN)CO_2-TPh$ | $N-CO_2-Ph$ | H | H | $p-CH_3-Ph$ | Ph |

Tph: 3-thiophene
Ph: Phenyl

The above electron transport material can be synthesized according to a conventional method.

Synthetic example of the typical compound will be shown below.

(Synthetic example)

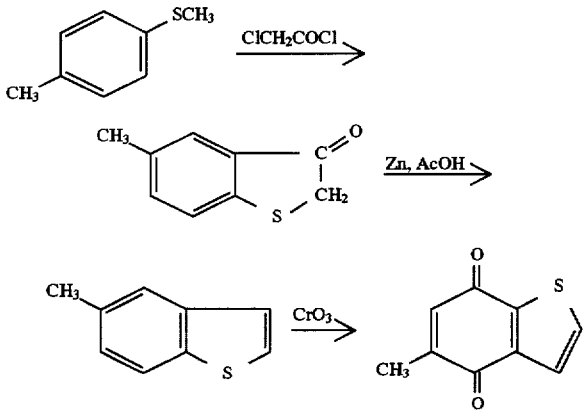

5-2

The Synthetic method of this compound is described in J. Amer. Chem. Soc., 67, 1943 (1945). The other compounds represented by Formula 5 can be similarly synthesized by changing substituents.

(F) Compounds represented by Formula 6

It is preferable that in Formula 6, $R^1$ and $R^4$ independently represent a hydrogen atom, $R^2$ and $R^3$ independently represent a substituted or unsubstituted aryl group, and $R^5$ and $R^6$ independently represent a substituted or unsubstituted alkyl group having 1 to 4 carbon atoms or a substituted or unsubstituted aryl group.

In Formula 6, the specially preferable examples are as follows:

6-1

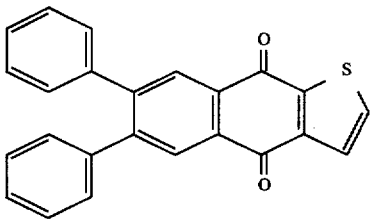

6-2

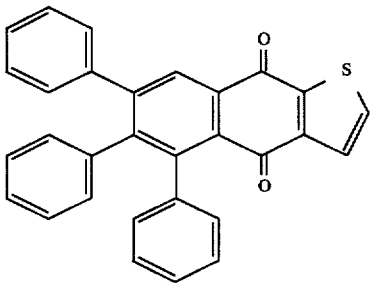

6-3

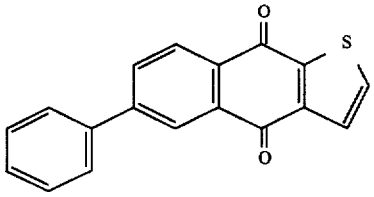

-continued 6-4

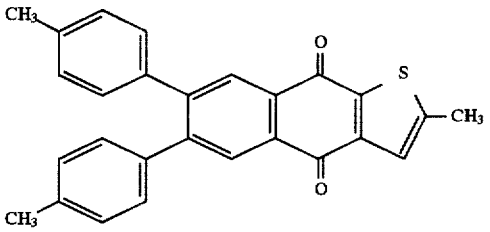

6-5

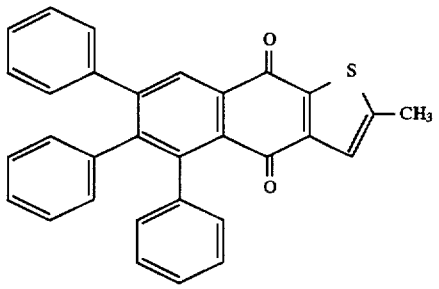

6-6

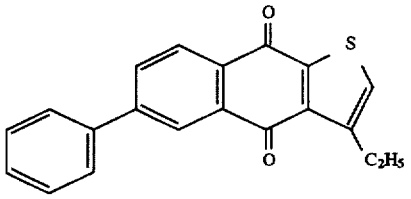

6-7

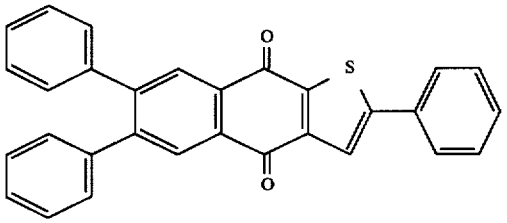

6-8

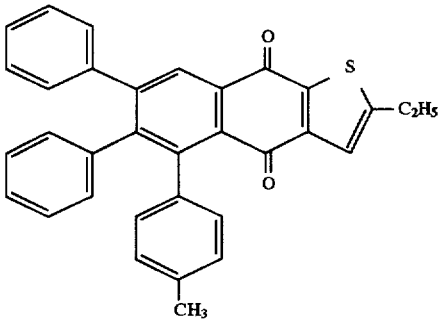

6-9

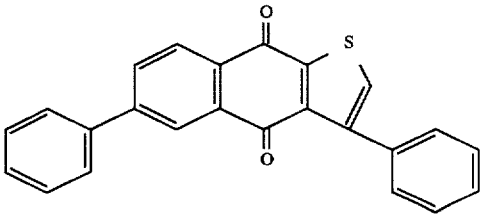

-continued 6-10

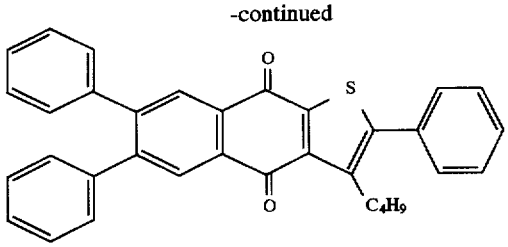

6-11

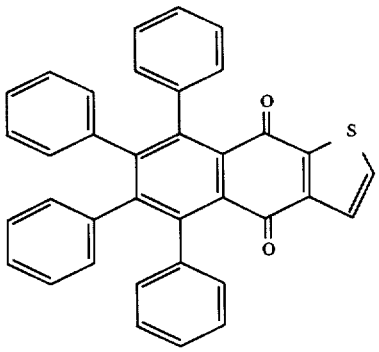

6-12

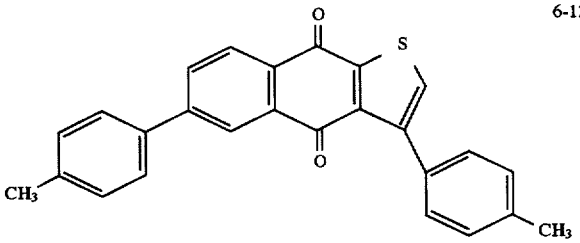

6-13

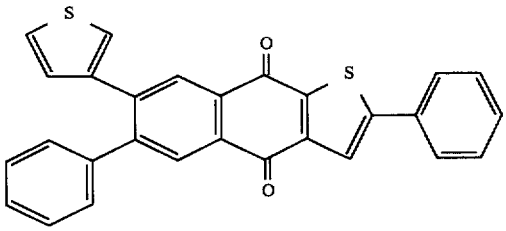

6-14

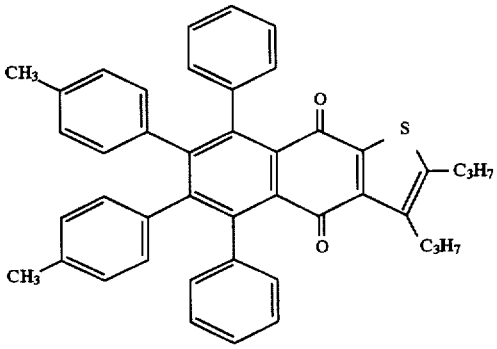

6-15

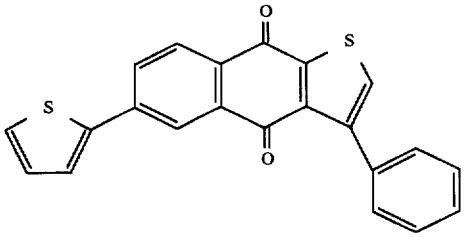

-continued 6-16

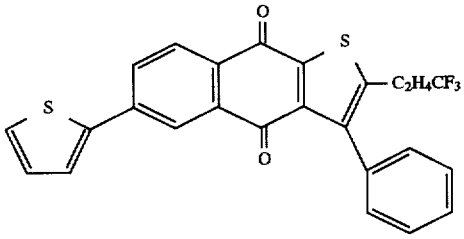

6-17

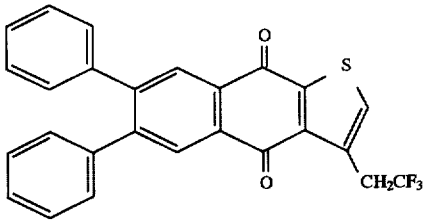

The above compound can be synthesized according to a conventional method. Synthetic example of the typical compound will be shown below.

(Synthetic example)

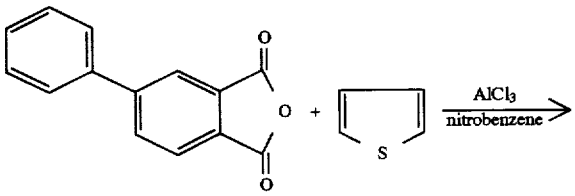

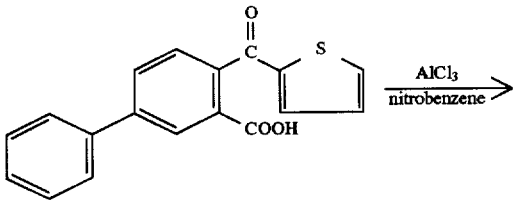

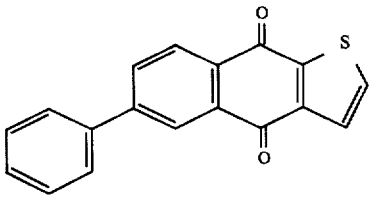

6-3

The Synthetic method of this compound is described in J. Amer. Chem. Soc., 74, 4353 (1952). The other compounds represented by Formula 6 can be similarly synthesized by changing substituents.

(G) Compounds represented by Formula 7

In Formula 7, $Ar^1$, $Ar^2$ and Ar' may have any substituent, and the substituent is preferably alkyl, alkoxy, aryl, aryloxy, halogen, nitro or cyano.

The examples of compounds represented by Formula 7 are as follows:

Formula 7
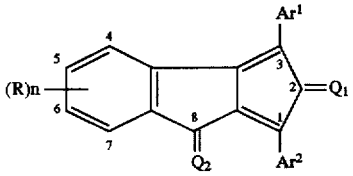
| No. | $Q_1$ | $Q_2$ | $Ar^1$ | $Ar^2$ | R |
|---|---|---|---|---|---|
| 7-1 | O | O | 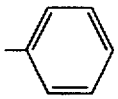 | 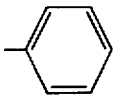 | H |
| 7-2 | O | O | 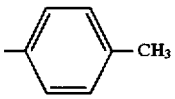 | 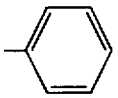 | H |
| 7-3 | O | O | 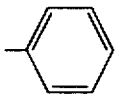 | 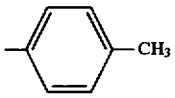 | H |
| 7-4 | O | O | 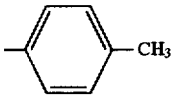 | 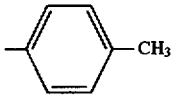 | H |
| 7-5 | O | O | 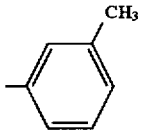 | 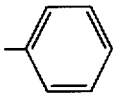 | H |
| 7-6 | O | O | 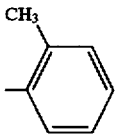 | 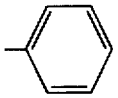 | H |
| 7-7 | O | O | 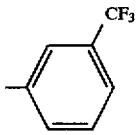 | 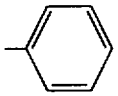 | H |
| 7-8 | O | O | 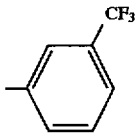 | 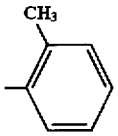 | H |
| 7-9 | O | O | 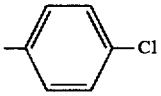 | 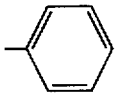 | H |
| 7-10 | O | O | 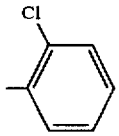 | 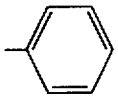 | H |
| 7-11 | O | O | 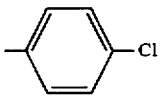 | 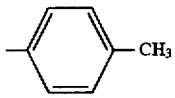 | H |

-continued
Formula 7
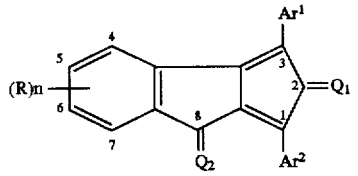
| No. | $Q_1$ | $Q_2$ | $Ar^1$ | $Ar^2$ | R |
|---|---|---|---|---|---|
| 7-12 | O | O | 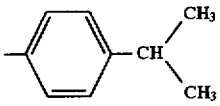 | 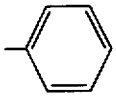 | H |
| 7-13 | O | O | 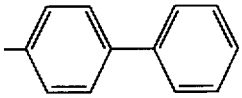 | 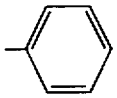 | H |
| 7-14 | O | O | 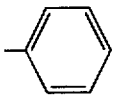 | 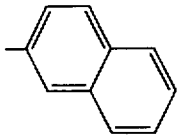 | |
| 7-15 | O | O | 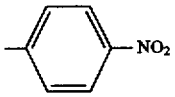 | 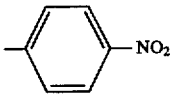 | H |
| 7-16 | 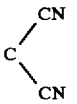 | O | 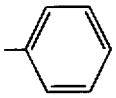 | 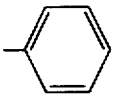 | H |
| 7-17 | 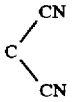 | O | 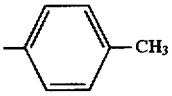 | 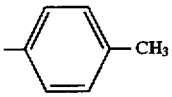 | H |
| 7-18 | 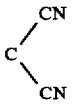 | O | 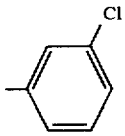 | 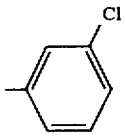 | H |
| 7-19 | 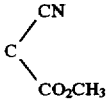 | O | 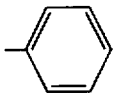 | 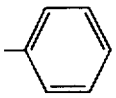 | H |
| 7-20 | 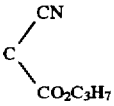 | O | 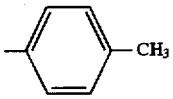 | 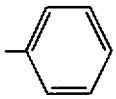 | H |
| 7-21 | 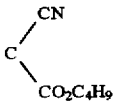 | O | 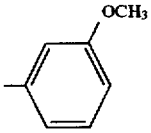 | 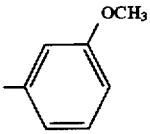 | H |
| 7-22 | 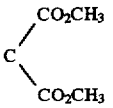 | O | 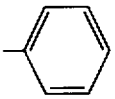 | 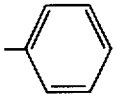 | H |

-continued
Formula 7
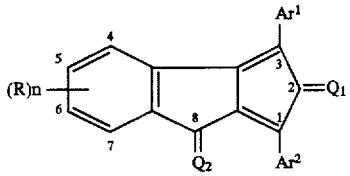
| No. | $Q_1$ | $Q_2$ | $Ar^1$ | $Ar^2$ | R |
|---|---|---|---|---|---|
| 7-23 | $C(CO_2C_2H_5)_2$ | O | 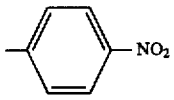 | 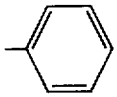 | H |
| 7-24 | $C(CO_2C_2H_5)_2$ | O | 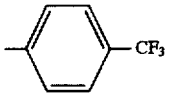 | 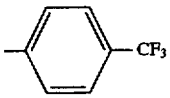 | H |
| 7-25 | N—C≡N | O | 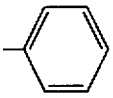 | 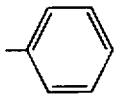 | H |
| 7-26 | N—C≡N | O | 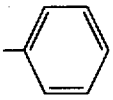 | 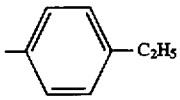 | H |
| 7-27 | N—C≡N | O | 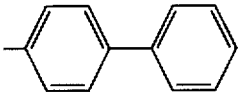 | 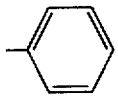 | H |
| 7-28 | 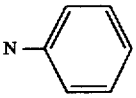 | O | 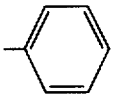 | 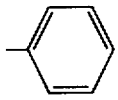 | H |
| 7-29 | 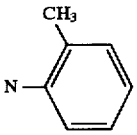 | O | 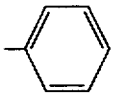 | 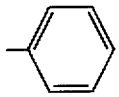 | H |
| 7-30 | 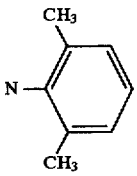 | O | 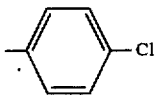 | 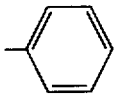 | H |
| 7-31 | O | 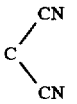 | 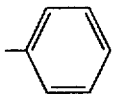 | 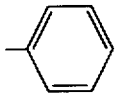 | H |
| 7-32 | O | 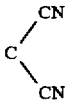 | 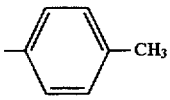 | 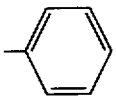 | H |
| 7-33 | O | 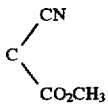 | 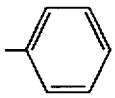 | 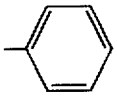 | H |

-continued
Formula 7
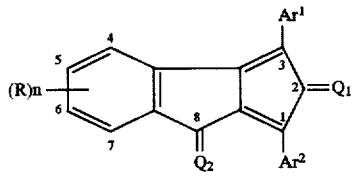
| No. | $Q_1$ | $Q_2$ | $Ar^1$ | $Ar^2$ | R |
|---|---|---|---|---|---|
| 7-34 | O | 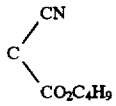 | 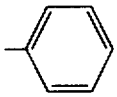 | 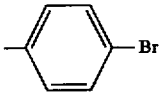 | H |
| 7-35 | O | 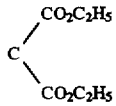 | 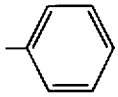 | 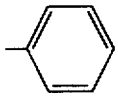 | H |
| 7-36 | O | 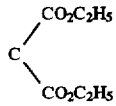 | 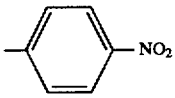 | 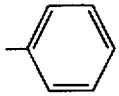 | H |
| 7-37 | O | N—C≡N | 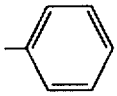 | 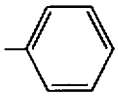 | H |
| 7-38 | O | N—C≡N | 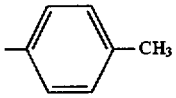 | 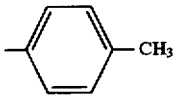 | H |
| 7-39 | O | 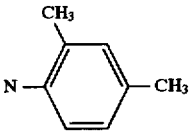 | 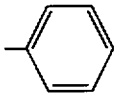 | 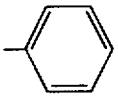 | H |
| 7-40 | O | 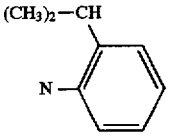 | 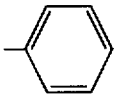 | 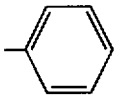 | H |
| 7-41 | 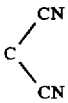 | 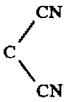 | 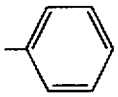 | 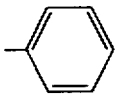 | H |
| 7-42 | 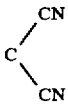 | 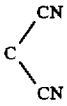 | 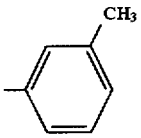 | 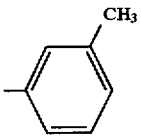 | H |
| 7-43 | 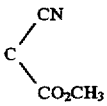 | 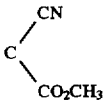 | 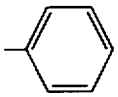 | 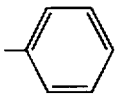 | H |
| 7-44 | 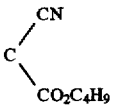 | 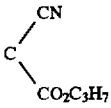 | 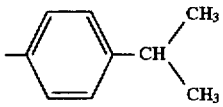 | 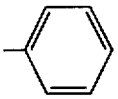 | H |

-continued
Formula 7
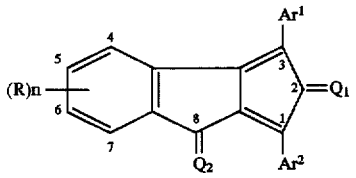
| No. | $Q_1$ | $Q_2$ | $Ar^1$ | $Ar^2$ | R |
|---|---|---|---|---|---|
| 7-45 | $C(CO_2C_2H_5)_2$ | $C(CO_2C_2H_5)_2$ | | | H |
| 7-46 | N—C≡N | N—C≡N | | | H |
| 7-47 | N—C≡N | N—C≡N | $CH_3$ | | H |
| 7-48 | N—C≡N | N—C≡N | | | H |
| 7-49 | N | N | | | H |
| 7-50 | N | N | | $CH_3$, $CH_3$ | H |
| 7-51 | N, $CH_3$ | N, $CH_3$ | | | H |
| 7-52 | $C(CN)_2$ | $C(CN)(CO_2C_2H_5)$ | | | H |
| 7-53 | $C(CN)_2$ | $C(CO_2CH_3)_2$ | | | H |
| 7-54 | $C(CN)_2$ | N—C≡N | | | H |
| 7-55 | $C(CN)_2$ | $CH_3$, N | | | H |

-continued
Formula 7
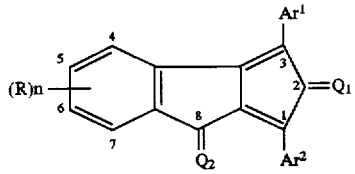
| No. | $Q_1$ | $Q_2$ | $Ar^1$ | $Ar^2$ | R |
|---|---|---|---|---|---|
| 7-56 | 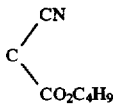 | 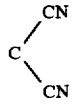 | 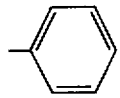 | 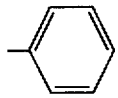 | H |
| 7-57 | 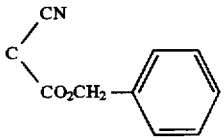 | 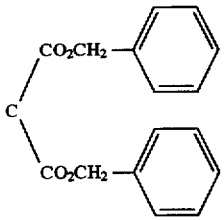 | 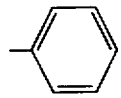 | 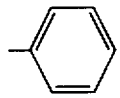 | H |
| 7-58 | 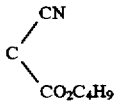 | N—C≡N | 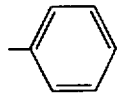 | 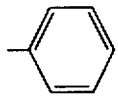 | H |
| 7-59 | 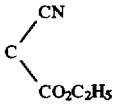 | 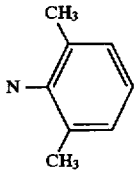 | 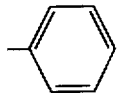 | 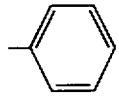 | H |
| 7-60 | 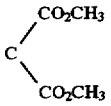 | 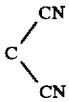 | 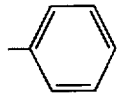 | 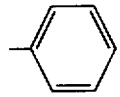 | H |
| 7-61 | 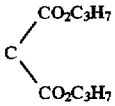 | 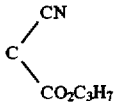 | 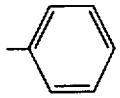 | 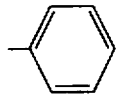 | H |
| 7-62 | 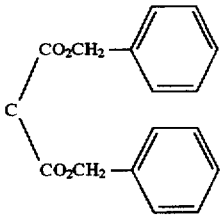 | N—C≡N | 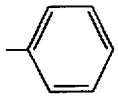 | 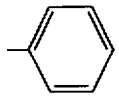 | H |
| 7-63 | 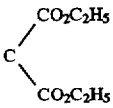 | 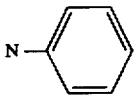 | 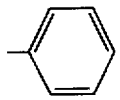 | 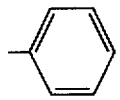 | H |
| 7-64 | N—C≡N | 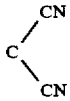 | 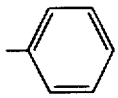 | 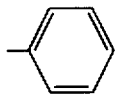 | H |
| 7-65 | N—C≡N | 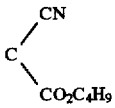 | 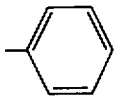 | 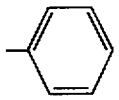 | H |

-continued
Formula 7
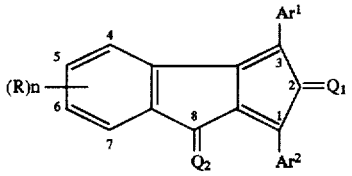
| No. | $Q_1$ | $Q_2$ | $Ar^1$ | $Ar^2$ | R |
|---|---|---|---|---|---|
| 7-66 | N—C≡N | $CO_2CH_3$ / C / $CO_2CH_3$ | | | H |
| 7-67 | N—C≡N | N | | | H |
| 7-68 | $CH_3$ / N / $CH_3$ / $CH_3$ | CN / C / CN | | | H |
| 7-69 | $CH_3$ / N / $CH_3$ | CN / C / $CO_2CH_3$ | | | H |
| 7-70 | $CH_3$ / N / $CH_3$ | $CO_2C_2H_5$ / C / $CO_2C_2H_5$ | | | H |
| 7-71 | $CH_3$ / N | N—C≡N | | | H |
| 7-72 | CN / C / CN | O | | | 5,6-$(CH_3)_2$ |
| 7-73 | CN / C / CN | O | | | 4 |
| 7-74 | O | O | | | 5,6 $)_2$ |
| 7-75 | O | O | | | 4,7 $)_2$ |
| 7-76 | O | O | | | 5-$NO_2$ |

-continued
Formula 7
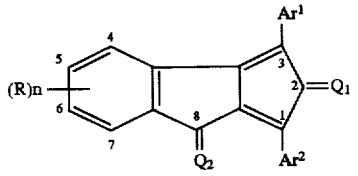
| No. | $Q_1$ | $Q_2$ | $Ar^1$ | $Ar^2$ | R |
|---|---|---|---|---|---|
| 7-77 | 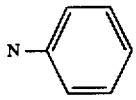 | O | 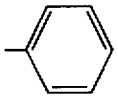 | 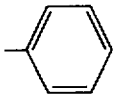 | 6-$NO_2$ |
| 7-78 | 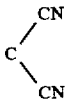 | O | 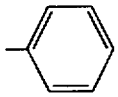 | 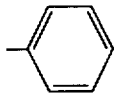 | 4-Cl |
| 7-79 | O | O | 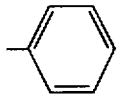 | 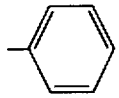 | 5-Br |
| 7-80 | O | O | 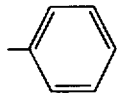 | 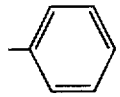 | 4-$CF_3$ |
| 7-81 | O | O | 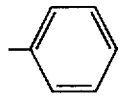 | 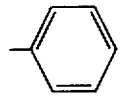 | 4,6-$(CF_3)_2$ |
| 7-82 | O | O | 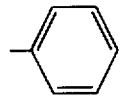 | 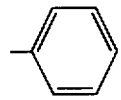 | 5-CN |
The above electron transport material can be synthesized according to a conventional method, for example, a method described in Chem. Ber., 99, 2675 (11966).
Synthetic example of the typical compound will be shown below.
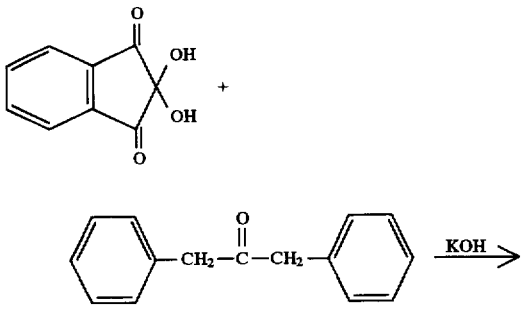
-continued
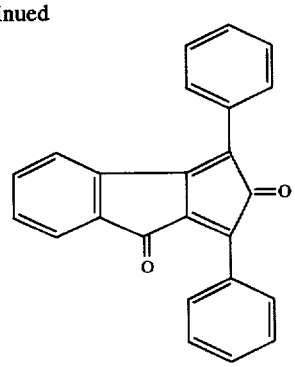
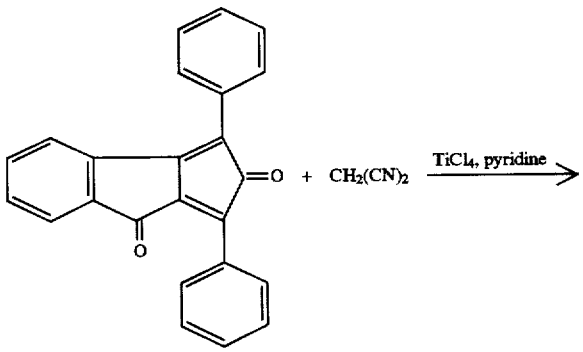

-continued
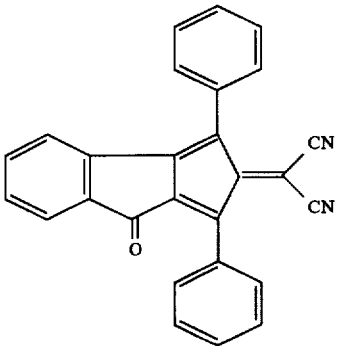
(H) Compounds represented by Formula 8
Exemplified compounds
8-1
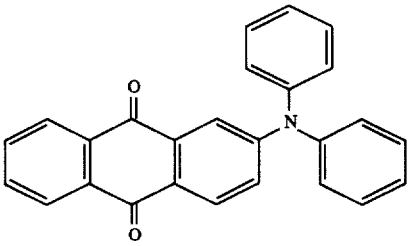
8-2
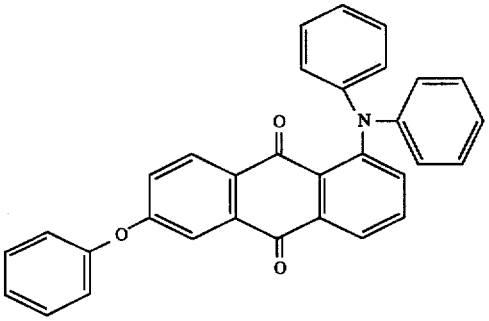
8-3
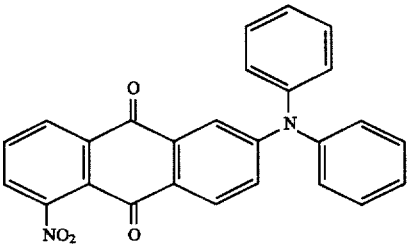
-continued
8-4
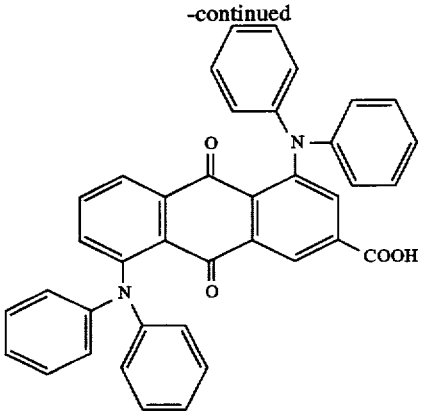
8-5
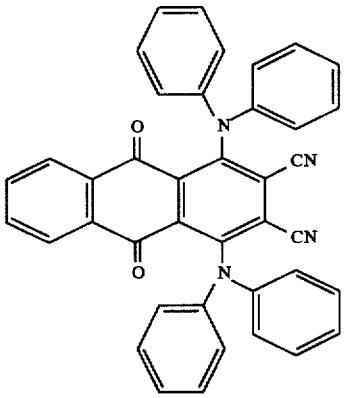
8-6
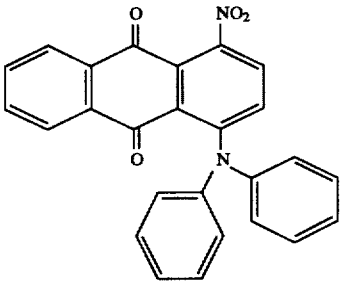
8-7
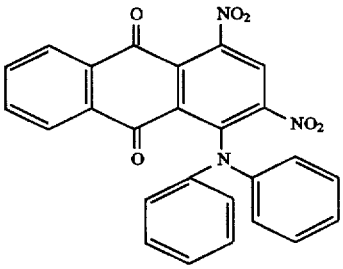
8-8
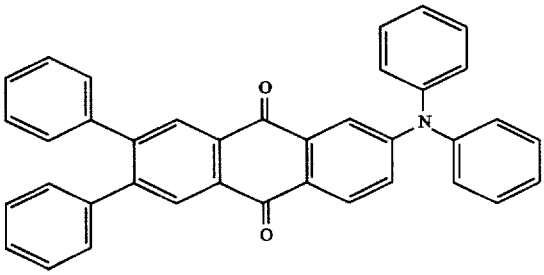

-continued
8-9
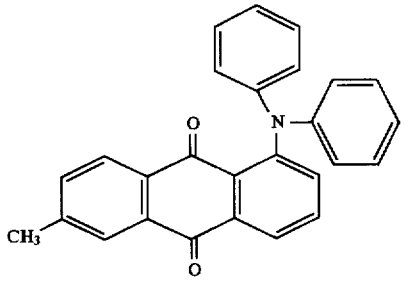
8-10
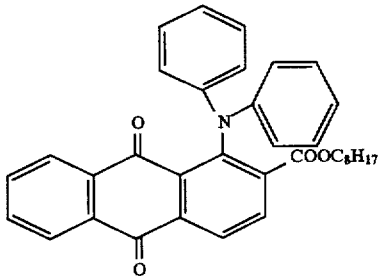
8-11
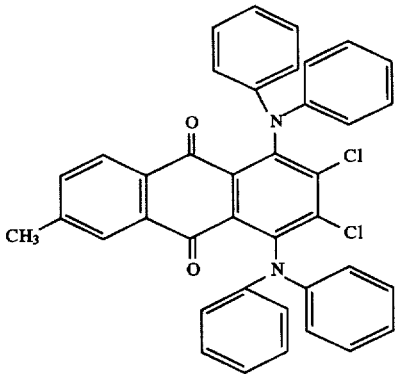
8-12
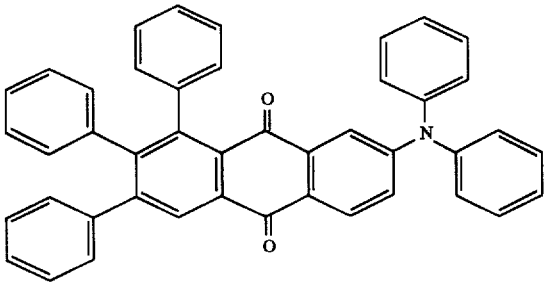
8-13
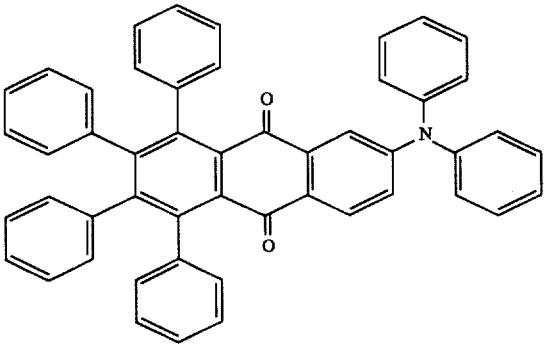
-continued
8-14
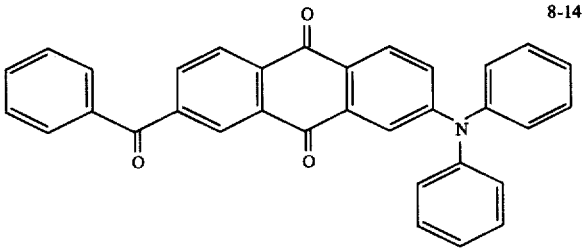
8-15
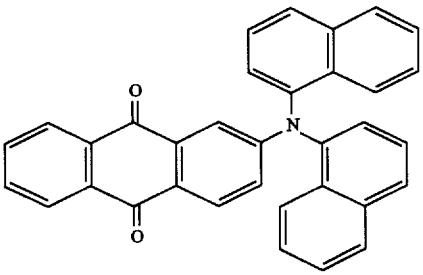
8-16
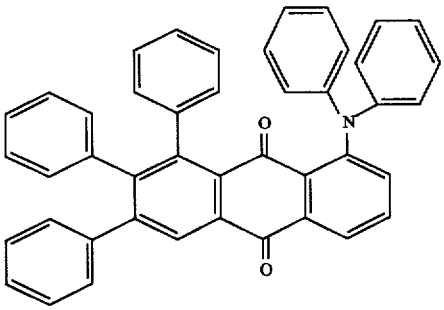
8-17
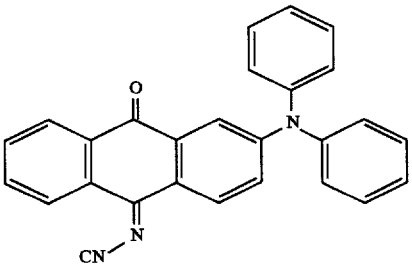
8-18
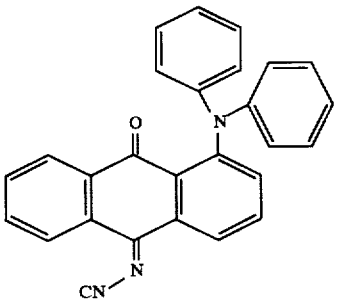

-continued
8-19
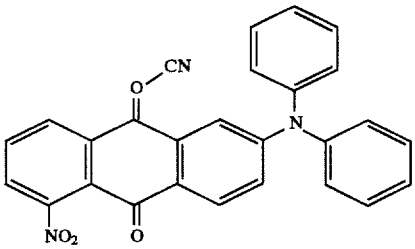
8-20
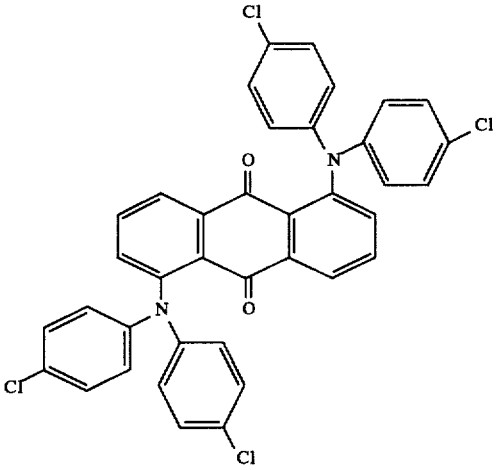
8-21
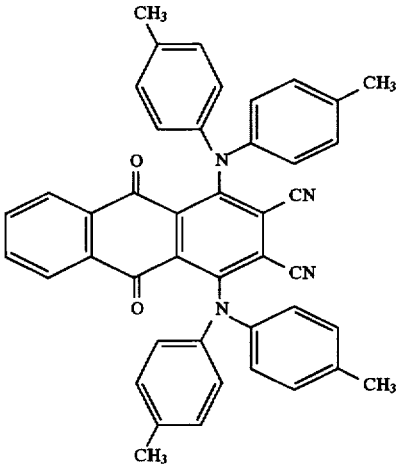
8-22
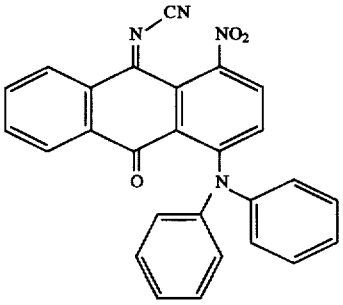
-continued
8-23
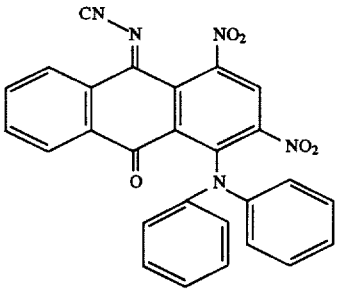
8-24
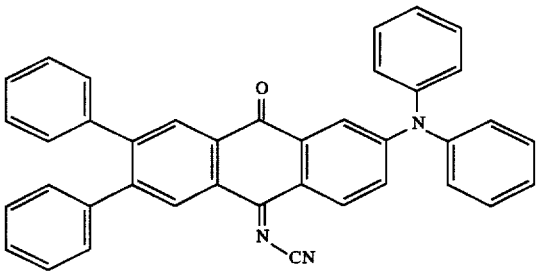
8-25
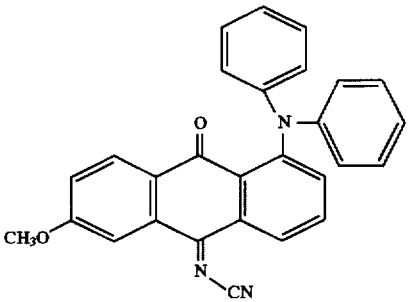
8-26
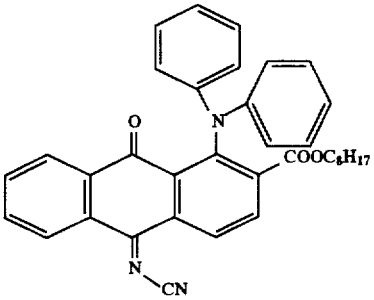
8-27
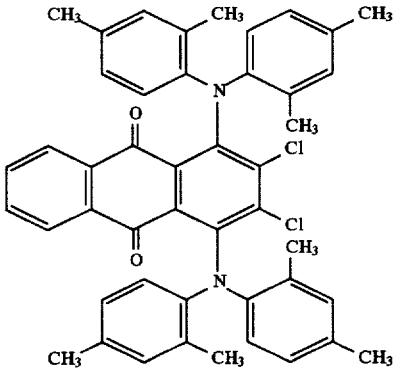

-continued 8-28

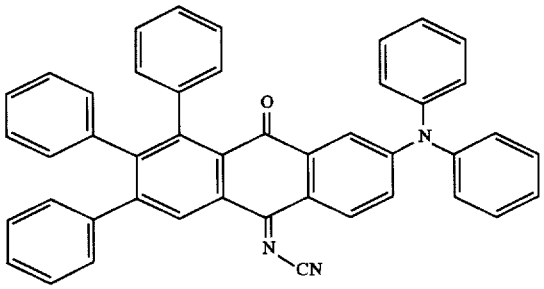

8-29

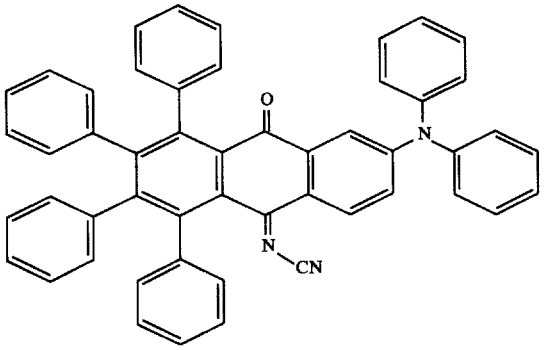

8-30

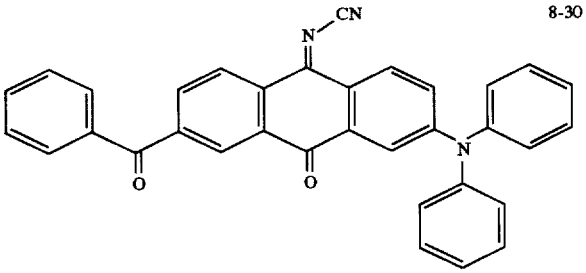

8-31

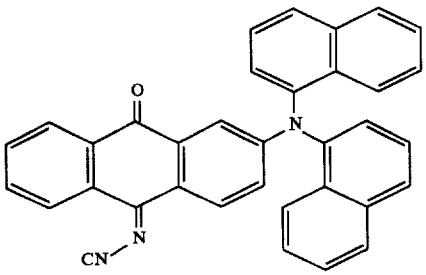

8-32

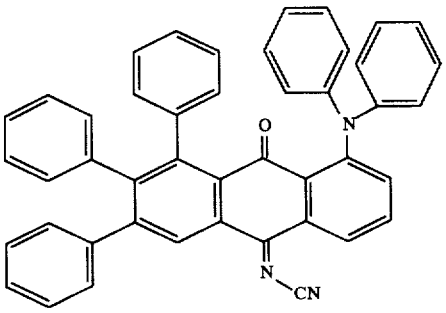

Synthetic Example (Synthesis of Exemplified compound 8-1)

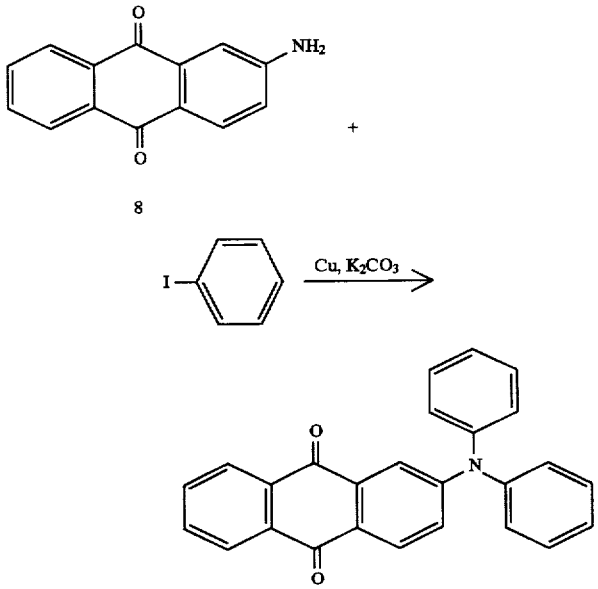

8-1

In a 100 ml three necked flask were mixed 5.0 g of Compound 8, 30 g of benzene iodide, 3.0 g of copper powder, and 9.3 g of $K_2CO_3$. The mixture was refluxed for ten hours, and the excessive benzene iodide was removed by distillation under reduced pressure. The organic residue was extracted with toluene. The toluene solution was washed with water and dried. The resulting solution was subjected to column chromatography and isolated. Thus, 5.4 g (yield 64%) of Exemplified compound 8-1 were obtained.

Synthetic Example

Synthesis of Exemplified compound 8-17

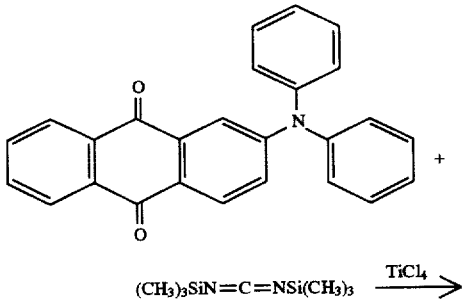

3

-continued

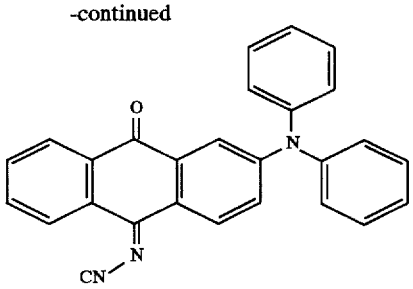

8-17

The above obtained Exemplified compound 8-1 was treated with titanium tetrachloride at 0°–5° C., and an equimolecular amount of Compound 3 was added and stirred for 24 hours art room temperature. The resulting mixture was poured into water, and extracted with toluene. The toluene solution was washed with water and dried The resulting solution was subjected to column chromatography and the objective crude compound was isolated.

Of the above described compounds, formula 2 or 3 compound is preferable, and formula 4 compound is more preferable.

The above compound in the invention has an excellent electron transport capability. The electrophotographic photoreceptor of the invention can be prepared by providing a photoreceptive layer dispersing the compound in a binder on a conductive support.

In the invention the so called functionally separating photoreceptor is prepared which comprises the compound in the invention having an excellent electron transport capability as a charge transport material in combination with a charge generation material. The above functionally separating photoreceptor may have a single layer containing the above described two materials in admixture, but preferably has a layer structure having a charge generation layer as a lower layer and a charge transport layer as an upper layer composed of the charge transport material of the invention. The functionally separating photoreceptor above may provide a subbing layer (intermediate layer) having a barrier capability or an adhesion on the support or may provide a protective layer on the surface of the photoreceptive layer.

The charge transport layer can be formed by dissolving or dispersing in an appropriate solvent the electron transport material of the invention singly or in combination of a binder, coating the solution or dispersion through an applicator, a bar coator or a dip coator and drying the coated.

The electrophotographic photoreceptor can be obtained using the electron transport material in the invention in combination with another electron transport material. The another electron transport material includes the following compounds, but is not limited thereto. thiopyrane derivatives disclosed in U.S. Pat. Nos. 4,514,481 and 5,039,585, benzoquinone derivatives disclosed in Japanese Patent O.P.I. Publication No. 8-15878/1996, fluorenone derivatives disclosed in Japanese Patent O.P.I. Publication No. 5-279582/1993 and U.S. Pat. No. 4,559,287, phthalic acid bisimide derivatives disclosed in U.S. Pat. No. 5,468,583, anthraquinone derivatives, indanone derivatives, indane derivatives and naphthoquinone derivatives. The content ratio by weight of the electron transport material in the invention to another electron transport material is 1:100 to 100:100, preferably 5:100 to 50:100, and more preferably 10:100 to 35:100. When the electron transport material in the invention is used in combination with another electron transport material, the electron transport material in the invention is preferably a compound represented by Formula 2 and more preferably a compound represented by Formula 4.

The binder used in the charge transport layer includes polystyrene resins, polyacryl resins, polymethacryl resins, polyvinyl chloride resins, polyvinyl acetate resins, polyvinyl butyral resins, epoxy resins, polyurethane resins, phenol resins, polyester resins, alkyd resins, polycarbonate resins, silicone resins or melamine resins and copolymers comprising two or more of a repeating unit contained in the above resins.

In addition to the above insulating resins, the binder also includes a photoconductive polymer such as poly N-vinyl carbazol.

The dispersing medium of the electron transport material includes hydrocarbons such as toluene and xylene, halogenated hydrocarbons such as methylene chloride and 1,2-dichloroethane, ketones such as methyl ethyl ketone and cyclohexanone, esters such as ethyl acetate and butyl acetate, alcohols such as methanol, ethanol, propanol, butanol, methylcellosolve, ethylcellosolve and their derivatives, ethers such as tetrahydrofurane and dioxane, amines such as pyridine and diethylamine, amides such as N,N-dimethylformamide, fatty acids, phenols, sulfur or phosphor compounds such as carbon disulfide, triethyl phosphate and a mixture thereof.

The content of the electron transport material in the charge transport layer is 5 to 200 parts by weight, preferably 20 to 200 parts by weight, more preferably 10 to 150 parts by weight, and farther more preferably 30 to 150 parts by weight based on the 100 parts by weight of the binder used. The thickness of the charge transport layer is preferably 5 to 30 μm. In the functionally separated photoreceptor having a single layered photoreceptive layer, the content ratio by weight of binder, electron transport material and charge generation material in the photoreceptive layer is preferably 1 to 100:1 to 500:1 to 500, and the thickness of the photoreceptive layer is preferably 5 to 50 μm.

The charge generation layer can be formed by dispersing, in an appropriate solvent, charge generation material singly or in combination of the binder above described, coating, on a support or on a subbing layer of the support, the dispersion solution by dip coating, spray coating, blade coating or roller coating and drying the coated. The charge generation layer can be formed by evaporation depositing charge generation material on a support or on a subbing layer of the support. The solvent used in the dispersion coating includes the same solvent as the above described solvent used in the coating of the electron transport material. Dispersion is carried out employing a ball mill, a homogenizer, a sand mill, an ultrasonic dispersing machine or attritor.

In the electrophotographic photoreceptor is used the conventional charge generation material, which includes, for example, an inorganic photoconductor such as selenium, various phthalocyanine compounds, azo compounds, pyrylium compounds, perylene compounds, cyanine compounds, squarium compounds, and multi-condensed quinone compounds.

In the photoreceptor having layered structure, the content ratio of binder and charge generation material in the charge generation layer is preferably 0 to 10:1 to 50, and the thickness of the charge generation layer is preferably 0.01 to μm, more preferably 0.1 to 5 μm.

The support, on which the photoreceptive layer is provided, includes a metal plate or drum made of aluminium or nickel, a plastic film on which aluminium, tin oxide or indium oxide is evaporation deposited, and paper.plasitic film or drum on which conductive material is provided.

The following anti-oxidant can be used in the photoreceptive layer of the invention to prevent deterioration due to ozone.

(1) Hindered phenol compounds, (2) Hindered amine compounds (3) para-Phenylenediamine compounds (4) Hydroquinones (5) Organic phosphor compounds.

These compounds are well known as an oxidant for rubber, plastics or fat and oil, and are available on the market.

The photoreceptor of the invention may contain an ultraviolet absorber for protecting the photoreceptive layer or dyes for correcting spectral sensitivity.

The binder used in the charge generation layer, intermediate layer or protective layer includes polystyrene resins, polyacryl resins, polymethacryl resins, polyvinyl chloride resins, polyvinyl acetate resins, polyvinyl butyral resins, epoxy resins, polyurethane resins, phenol resins, polyester resins, alkyd resins, polycarbonate resins, silicone resins or melamine resins and copolymers comprising two or more of a repeating unit contained in the above resins. In addition to the above insulating resins, the binder also includes a photoconductive polymer such as poly N-vinyl carbazol.

The dispersing medium of the charge generation material or charge transport material includes hydrocarbons such as toluene and xylene, halogenated hydrocarbons such as methylene chloride and 1,2-dichloroethane, ketones such as methyl ethyl ketone and cyclohexanone, esters such as ethyl acetate and butyl acetate, alcohols such as methanol, ethanol, propanol, butanol, methylcellosolve, ethylcellosolve and their derivatives, ethers such as tetrahydrofurane and dioxane, amines such as pyridine and diethylamine, amides such as N,N-dimethylformamide, fatty acids, phenols, sulfur or phosphor compounds such as carbon disulfide, triethyl phosphate and a mixture thereof.

EXAMPLES

The invention will de detailed in the following examples, but is not limited thereto. In the Examples or Comparative examples, "parts" is in terms of weight parts.

Examples

Examples 1 through 8

On a polyester film support having a vapor-deposit aluminum layer a dispersion solution, in which one part of titanyl phthalocyanine and 0.5 parts of a silicone-butyral resin were dispersed in 50 parts of methyl isopropyl ketone using a sand mill, was coated by means of a wire bar with. The titanyl phthalocyanine had peaks at 9.5°, 24.1° and 27.2° of Bragg angle 2θ in X-ray diffractmetry. Thus, a charge generation layer was formed to have a thickness of 0.3 μm. On the charge generating layer was coated by means of a doctor blade a solution in which 0.4 parts of Exemplified compounds shown in the following Table 1 and 1.5 parts of a polycarbonate resin IUPILON Z200 produced by Mitsubishi Gasukagaku Co., Ltd. were dissolved in 10 parts of tetrahydrofurane (THF) to obtain a charge transport layer having a thickness of 20 μm. Thus, inventive photoreceptor samples 1 through 8 were obtained.

Comparative example 1

Comparative sample 1 was prepared in the same manner as in Example 1, except that the comparative compound K-1 described later was used instead of Exemplified compound 2-3.

TABLE 1

| Sample No. | Exemplified compounds |
|---|---|
| 1 | 2–3 |
| 2 | 2–5 |
| 3 | 2–7 |
| 4 | 2–9 |
| 5 | 2–12 |
| 6 | 2–32 |
| 7 | 2–16 |
| 8 | 2–18 |
| **Comparative sample No.** | **Comparative compound No.** |
| 1 | K-1 |

Evaluation 1

The photoreceptor samples 1 through 8 and comparative sample 1 obtained above were evaluated using an electrostatic copier tester EPA-8100 produced by Kawaguchi Denki Co. After the samples were charged with 6 kV and exposed to white light with 1 lux for 10 seconds, the residual surface potential was measured. The results are shown in Table 2.

TABLE 2

| Sample No. | Residual surface potential (V) |
|---|---|
| 1 | 320 |
| 2 | 280 |
| 3 | 250 |
| 4 | 295 |
| 5 | 18 |
| 6 | 4 |
| 7 | 2 |
| 8 | 16 |
| Comparative sample No. 1 | 1100 |

K-1

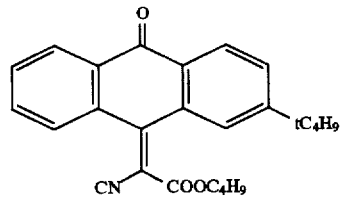

As is apparent from Table 2, Samples 1 through 8 have far lower residual potential as compared with Comparative sample 1.

Example 10

Example 10-1

On a polyester film support having a vapor-deposit aluminum layer was provided a 0.5 μm intermediate layer composed of a polyamide resin "CM8000" (produced by Toray Co., Ltd.) and the intermediate layer was coated by means of a wire bar with a dispersion solution in which one part of titanyl phthalocyanine and 0.5 parts of a silicone-butyral resin were dispersed in 50 parts of methyl isopropyl ketone using a sand mill. The titanyl phthalocyanine had peaks at 9.5°, 24.1° and 27.2° of Bragg angle 2θ to CuKα specific X-ray. Thus, a charge generation layer was formed to have a thickness of 0.3 μm. On the charge generating layer was coated by means of a doctor blade a solution in which one part of Exemplified compound 3-1 and 2 parts of a polycarbonate resin IUPILON Z200 produced by Mitsubishi Gasukagaku Co., Ltd. were dissolved in 15 parts 1,2-dichloroethane to obtain a charge transport layer having a thickness of 15 μm. Thus, inventive photoreceptor sample 10-1 was obtained.

Examples 10-2 through 10-10

Inventive samples 10-2 through 10-10 were prepared in the same manner as in Example 10-1, except that Exemplified compounds as shown in Table 3 were used instead of Exemplified compound 3-1.

Comparative examples 10-1 and 10-2

Comparative samples 10-1 and 10-2 were prepared in the same manner as in Example 10-1, except that the following comparative compounds K-2 and K-3 were used, respectively, instead of Exemplified compound 3-1.

K-2

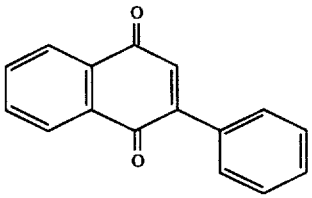

K-3

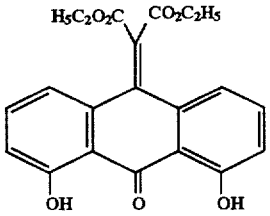

Evaluation 1

The photoreceptor samples 10-1 through 10-10 and comparative samples 10-1 and 10-2 obtained above were evaluated using an electrostatic copier tester EPA-8100 produced by Kawaguchi Denki Co. The samples were charged to give a surface potential of +800 V and exposed to 10 lux of white light. Exposure $E_{1/2}$ (lux.sec.) necessary to obtain half of initial surface potential was measured and defined as sensitivity. The results are shown in Table 3.

TABLE 3

| Sample No. | Exemplified compound No. | $E_{1/2}$(lux · sec.) |
|---|---|---|
| 10-1 | 3-1 | 2.3 |
| 10-2 | 3-2 | 2.6 |
| 10-3 | 3-3 | 2.0 |
| 10-4 | 3-19 | 2.7 |
| 10-5 | 3-38 | 2.9 |
| 10-6 | 3-42 | 1.8 |
| 10-7 | 3-45 | 1.5 |
| 10-8 | 3-55 | 2.2 |
| 10-9 | 3-61 | 1.6 |
| 10-10 | 3-63 | 2.5 |
| **Comparative sample No.** | **Exemplified compound No** | **$E_{1/2}$ (lux · sec.)** |
| 10-1 | (K-2) | 5.1 |
| 10-2 | (K-3) | 8.5 |

As is apparent from Table 3, Samples 10-1 through 10-10 have far higher sensitivity as compared with Comparative samples 10-1 and 10-2.

Examples 11-1 through 11-5

Photoreceptor samples 11-1 through 11-5 were prepared in the same manner as in Example 1, except that exemplified compounds of Formula 4, compounds 4-5, 4-6, 4-7, 4-8 and 4-9 were used, respectively, instead of Exemplified compound 2-3.

The above obtained samples were evaluated in the same manner as in Examples 1-8. The results are shown in Table 4.

TABLE 4

| Sample No. | Exemplified compound No. | Residual surface potential (V) |
|---|---|---|
| 11-1 | 4-5 | 0 |
| 11-2 | 4-6 | 0 |
| 11-3 | 4-7 | 0 |
| 11-4 | 4-8 | 2 |
| 11-5 | 4-9 | 2 |
| Comparative sample No. 1 | Comparative compound No. K-1 | 1100 |

As is apparent from Table 4, the photoreceptor samples employing compounds of Formula 4 show electrophotographic property superior to photoreceptor samples 1 through 8.

What is claimed is:

1. An electrophotographic photoreceptor comprising a conductive support and provided thereon a photoreceptive layer comprising a charge generation material and a charge transport material in admixture or a photoreceptive layer comprising a charge generation layer as a lower layer and a charge transport layer containing a charge transport material as an upper layer, said charge transport material being a compound represented by the following Formula 1:

Formula 1

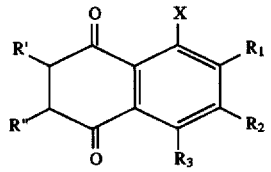

wherein X represents a group capable of forming a hydrogen bond; and $R_1$, $R_2$ and $R_3$ are independently selected from the group consisting of a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group, —$NH_2$, —NHR and —NHCOR, in which R represents alkyl or aryl; and R' and R" are independently selected from the group consisting of a hydrogen atom, an alkyl group and an aryl group or R' and R" combine with each other to form a ring.

2. The electrophotographic photoreceptor of claim 1, wherein said compound is represented by the following Formula 2 or 3:

Formula 2

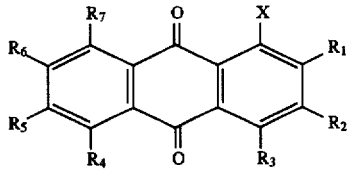

wherein X represents a group capable of forming a hydrogen bond; and $R_1$, $R_2$, $R_3$, $R_4$, $R_5$, $R_6$ and $R_7$ are independently selected from the group consisting of a hydrogen atom, a halogen atom, an alkyl group, an aralkyl group, an alkoxy group, an aryl group, an aryloxy group, a heterocyclic group, a hydroxy group, a nitro group, a cyano group, an acyl group, a urethane group, a carboxyl group, a carboxylate ester group, an amido group, —$NH_2$, —NHR and —NHCOR, in which R represents alkyl or aryl group, Formula 3

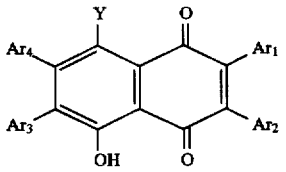

wherein Y is a hydrogen atom or a hydroxy group; and $Ar_1$, $Ar_2$, $Ar_3$ and $Ar_4$ are independently selected from the group consisting of a hydrogen atom and an aryl group.

3. The electrophotographic photoreceptor of claim 2, wherein said compound is represented by said Formula 2.

4. The electrophotographic photoreceptor of claim 3, wherein said compound represented by said Formula 2 is represented by Formula 4:

Formula 4

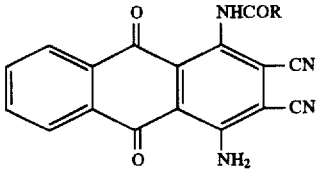

wherein R is an alkyl group or an aryl group.

5. The electrophotographic photoreceptor of claim 4, wherein said R is an alkyl group having 5 to 9 carbon atoms.

6. The electrophotographic photoreceptor of claim 1, wherein said X in Formula 1 is a hydroxy group, an amino group, an alkylamino group, an arylamino group, an acylamino group, an amido group, a carboxyl group, a carboxyamino group, an alkoxycarbonylamino group, an aryloxycarbonylamino group, a sulfonamide group, a sulfonylamino group or a sulfinylamino group.

7. The electrophotographic photoreceptor of claim 2, wherein said X in Formula 2 or 3 is a hydroxy group, an amino group, an alkylamino group, an arylamino group, an acylamino group, an amido group, a carboxyl group, a carboxyamino group, an alkoxycarbonylamino group, an aryloxycarbonylamino group, a sulfonamide group, a sulfonylamino group or a sulfinylamino group.

8. The electrophotographic photoreceptor of claim 1, wherein a charge transport layer in said photoreceptive layer contains a binder and said compound in an amount of 5 to 200 parts by weight based on 100 parts by weight of the binder.

9. The electrophotographic photoreceptor of claim 2, wherein said X in Formula 2 or 3 is a hydroxy group, an amino group, an alkylamino group, an arylamino group, an acylamino group or an amido group.

10. The electrophotographic photoreceptor of claim 1, wherein said X in Formula 1 is a hydroxy group, an amino group, an alkylamino group, an arylamino group, an acylamino group or an amido group.

* * * * *